US007718136B2

(12) United States Patent
Ohtsuka et al.

(10) Patent No.: US 7,718,136 B2
(45) Date of Patent: May 18, 2010

(54) FINE PARTICLE DIFFUSER AND REFRIGERATOR WITH THE SAME

(75) Inventors: Masaki Ohtsuka, Osaka (JP); Yoshikazu Inoue, Yao (JP); Takashi Yoshikawa, Izumi (JP)

(73) Assignee: Sharp Kabushiki Kaisha, Osaka (JP)

( * ) Notice: Subject to any disclaimer, the term of this patent is extended or adjusted under 35 U.S.C. 154(b) by 642 days.

(21) Appl. No.: 10/569,415

(22) PCT Filed: Jul. 13, 2004

(86) PCT No.: PCT/JP2004/009954

§ 371 (c)(1),
(2), (4) Date: Feb. 23, 2006

(87) PCT Pub. No.: WO2005/026634

PCT Pub. Date: Mar. 24, 2005

(65) Prior Publication Data

US 2006/0263280 A1 Nov. 23, 2006

(30) Foreign Application Priority Data

Sep. 8, 2003 (JP) ..... 2003-315981
Sep. 8, 2003 (JP) ..... 2003-316034

(51) Int. Cl.
*A62B 7/08* (2006.01)
*A61L 9/00* (2006.01)
*F24F 3/16* (2006.01)

(52) U.S. Cl. ..... 422/124; 422/120; 422/123; 422/5; 62/78

(58) Field of Classification Search ..... 62/410
See application file for complete search history.

(56) References Cited

U.S. PATENT DOCUMENTS 5,531,484 A * 7/1996 Kawano ..... 285/179.2
6,290,266 B1 * 9/2001 Kawano ..... 285/125.1

(Continued)

FOREIGN PATENT DOCUMENTS

JP 02130345 A * 5/1990

(Continued)

OTHER PUBLICATIONS

English machine translation of Abstract for JP 02-130345.*

(Continued)

*Primary Examiner*—Elizabeth L McKane
*Assistant Examiner*—Regina Yoo
(74) *Attorney, Agent, or Firm*—Birch, Stewart, Kolasch & Birch, LLP

(57) ABSTRACT

It is an object of the invention to provide a microparticle diffusing apparatus capable of largely elongating the spray travel distance of microparticles emitted from the microparticle diffusing apparatus and, also, capable of emitting the microparticles in a wide range, enhancing the effect of the microparticles and reducing the noise. The microparticle diffusing apparatus includes a microparticle generating apparatus which generates microparticles from a microparticle generating part, a wind-blowing path which transfers the microparticles generated from the microparticle generating apparatus, and a blowout opening which is formed in an end of the wind-blowing path and which discharges the microparticles, and an aspect ratio of a cross section of the wind-blowing path is gradually increased from a start point to an end point.

15 Claims, 32 Drawing Sheets

U.S. PATENT DOCUMENTS

| | | | | |
|---|---|---|---|---|
| 6,330,154 | B1 * | 12/2001 | Fryers et al. | 361/695 |
| 6,865,896 | B2 * | 3/2005 | Kaji et al. | 62/78 |

FOREIGN PATENT DOCUMENTS

| | | | | |
|---|---|---|---|---|
| JP | 7-167087 | A | | 7/1995 |
| JP | 07269524 | A | * | 10/1995 |
| JP | 8-56630 | A | | 3/1996 |
| JP | 2001-95544 | A | | 4/2001 |
| JP | 2001221565 | A | * | 8/2001 |
| JP | 2002-85544 | A | | 3/2002 |
| JP | 2002-204622 | A | | 7/2002 |
| JP | 2002-206163 | A | | 7/2002 |
| JP | 2003153995 | A | * | 5/2003 |

OTHER PUBLICATIONS

English machine translation of JP 2001-221565.*
English machine translation of JP 2003-153995.*
English machine translation of JP 08-056630.*
English translation of JP 02-130345.*
English Machine translation of JP 07-269524.*

* cited by examiner

FINE PARTICLE DIFFUSER AND REFRIGERATOR WITH THE SAME

TECHNICAL FIELD

The present invention relates to a microparticle diffusing apparatus which emits microparticles in a wide range, and a refrigerator having the same.

BACKGROUND ART

One example of microparticles emitted by a microparticle diffusing apparatus may include ion. One example of the ion includes so-called cluster ion which becomes $H^+(H_2O)_n$ and $O_2^-(H_2O)_m$. An ion diffusing apparatus (see FIG. 36) of a comparative example 2, which will be described later, comprises an ion generating apparatus 14 which generates the ion. A refrigerator (see FIG. 35) having the ion diffusing apparatus is described in Patent Publications 1 and 2. This refrigerator discharges ion outside the refrigerator to sterilize a periphery outside the refrigerator. By sterilizing suspended bacteria outside the refrigerator, a sanitary living space is provided, suspended bacteria are prevented from coming into the refrigerator from outside when its door is opened/closed, and sanitary inside environment of the refrigerator is realized.

Patent Publication 1: JP-A 2002-204622

Patent Publication 2: JP-A 2002-206163

DISCLOSURE OF THE INVENTION

Problems to be Solved by the Invention

In the case of the conventional ion diffusing apparatus, however, since a spray travel distance of the jet stream is short, and the ion diffusing apparatus is not suitable for conveying fluid in a wide range. Therefore, the refrigerator having the ion diffusing apparatus has inferior dispersing ability of ion as compared with the amount of ion generation, i.e., inferior dispersing ability of microparticles having the sterilizing effect.

FIG. 37 shows ion concentrations of various portions in a room at 15° C. in temperature when cluster ions are discharged into the room from an outer-side ion blowout opening 22 of a refrigerator 200 having a conventional ion diffusing apparatus 110*a*. Herein, the sterilizing effect has been confirmed when the plus ion concentration is 2000 ions/cm$^3$ or more and the minus ion concentration is 2000 ions/cm$^3$ or more.

In FIG. 37, although there exist ions having high concentration around the outer-side ion blowout opening 22, its region is narrow and this is not always sufficient. For example, ion concentration at a position in front of the outer-side ion blowout opening 22 by 10 mm is about 100000 ions/cm$^3$. Although sufficient ions are generated from the ion generating apparatus 14, ions of high concentration are retained in the vicinity of the blowout opening, and the ions are not dispersed over the entire room.

In order to increase the region having high concentration of emitted microparticles, the rotation number of a blower 12 should be increased, but this method has a problem that the blowing noise is largely increased. Further, in order to increase the region having high concentration of emitted microparticles, the generating amount of microparticles from the microparticle generating apparatus should be increased. In the case of the ion generating apparatus, however, this causes other problems that it is necessary to largely increase the voltage to be applied to the ion generating apparatus 14, the ion generating noise is increased, and the amount of ozone simultaneously generated when the ions are generated.

Like the conventional ion diffusing apparatus 110*a*, many microparticle diffusing apparatuses which disperse the microparticles in the air are incorporated in electric home appliances, but this also has a problem that the dispersing ability of microparticles is low.

The present invention has been accomplished in view of the above problems, and it is an object of the invention to provide a microparticle diffusing apparatus capable of largely elongating the spray travel distance of the microparticles emitted from the microparticle diffusing apparatus and, also, capable of emitting the microparticles in a wide range, enhancing the effect of the microparticles and reducing the noise. It is another object of the invention to provide a refrigerator having the microparticle diffusing apparatus.

Means for Solving the Problem

To achieve the above object, the present invention is characterized in that an aspect ratio of a cross section of a wind-blowing path is gradually changed from a start point to an end point. By appropriately setting the rate of change of the aspect ratio, the attenuation of the wind velocity discharged from a blowout opening can be suppressed and thus, the spray travel distance of microparticles can be elongated and the microparticles can be transferred over the wide range.

If the enlarging rate of the aspect ratio or the enlarging rate of the cross-sectional area is selected to appropriate values, diffuser effect can be obtained and the sending out ability of microparticles can be enhanced.

If an aspect ratio AR of the cross section in the end point of the wind-blowing path is set to $2 \leqq AR \leqq 20$ or $5 \leqq AR \leqq 22$, preferably $5 \leqq AR \leqq 20$, the attenuation of the wind velocity of the jet stream sent out from the blowout opening can be suppressed, and the spray travel distance of microparticles can be elongated. Therefore, it is possible to increase the concentration of microparticles existing at a relatively far place.

If the wind-blowing path is divided into a plurality of paths or divided by a wind introducing plate, the aspect ratio of the blowout opening can easily be set to an optimal value without being limited by a size, and microparticles can be discharged uniformly from the blowout opening, and it is possible to sent uniform microparticles to a distant place.

It is preferable that the aspect ratio AR of the cross section in the start point of the wind-blowing path satisfies a relation of $AR \leqq 2$.

According to the present invention, by providing the wind direction changing plate in the vicinity of the blowout opening, it is possible to intensively discharge microparticles sent out from the microparticle generating apparatus in a desired direction with a simple structure, and to disperse in a wide range.

According to the present invention, air flowing in the vicinity of the microparticle generating apparatus is rectified by a rectifier to reduce the disturbance, thereby preventing the microparticle-generating efficiency from being deteriorated, and it is possible to reduce the collision probability between the microparticles. For example, when the microparticle generating apparatus is an ion generating apparatus which generates substantially the same amounts of plus ions and minus ions, it is possible to prevent the generated plus ions and minus ions from colliding against each other to lose the electric charge and thus, the transfer efficiency of ions can be prevented from being deteriorated. That is, the disturbance is rectified at upstream of the microparticle generating apparatus, thereby preventing the microparticle-generating efficiency and microparticle-transfer efficiency from being deteriorated.

According to the present invention, the turbulent flow can be rectified by the narrow portion, and air flowing in the vicinity of the microparticle generating apparatus can be rectified to reduce the disturbance. Thus, substantially the same effect as that described above can be realized without using a special device.

According to the present invention, if a width of the microparticle generating part in a direction perpendicular to a flow of the microparticles is defined as w1 and a width of the wind-blowing path facing the microparticle generating part is defined as w2, a relation of $0.7 \times w1 \leqq w2 \leqq 1.3 \times w1$ or, preferably, $w2 = w1$ is established. With this configuration, it is possible to efficiently transfer the microparticles and to disperse the same.

Further, in the invention, an air filter prevents greasy fumes or dust from entering the microparticle diffusing apparatus, and prevents the microparticle generating apparatus from being contaminated, and reduction of generating amount of microparticles with time can be suppressed.

In the invention, since the blowout opening is provided in the ceiling of the refrigerator, microparticles can be dispersed further, and a space capable of sterilize microorganism such as floating germs existing in periphery of the refrigerator can be enlarged. Therefore, when the door is opened or closed, it is possible to prevent suspended bacteria from entering the refrigerator from outside, and sanitary inside environment of the refrigerator can be obtained.

In the invention, since the blowout opening is provided in the upper portion of the front surface of the refrigerator, it is possible to disperse the microparticles having a sterilizing function toward the front surface of the refrigerator intensively. Therefore, when the door is opened or closed, it is possible to prevent suspended bacteria from entering the refrigerator from outside, and more sanitary inside environment of the refrigerator can be obtained.

In the invention, since the microparticles are discharged downward from the blowout opening with respect to the horizontal plane, it is possible to disperse the microparticles having the sterilizing function efficiently to the space outside the refrigerator. Further, microorganism such as suspended bacteria existing around the refrigerator fall with time by gravity and are accumulated on a lower portion of the space. Therefore, if the ions are sent out downward with respect to the horizontal plane, the microorganisms can efficiently be sterilized. Especially in the case of a refrigerator which is provided at its ceiling or upper portion of its front surface with the microparticle diffusing apparatus having the sterilizing function and which has height of 1700 mm to 1800 mm, it is possible to effectively disperse the microparticles having the sterilizing function to a position of 1300 mm to 1500 mm in height from the floor surface and thus, it is possible to effectively prevent a user from inhaling the microorganisms such as virus.

ADVANTAGES OF THE INVENTION

According to the present invention, it is possible to largely elongate the spray travel distance of the microparticles (microparticles having the sterilizing effect) emitted from the microparticle diffusing apparatus by optimally setting the aspect ratio of the blowout opening, and it is possible to emit the microparticles in a wide range, to enhance the effect of the microparticles, and to reduce the noise.

LIST OF REFERENCE SYMBOLS

Figure 1:
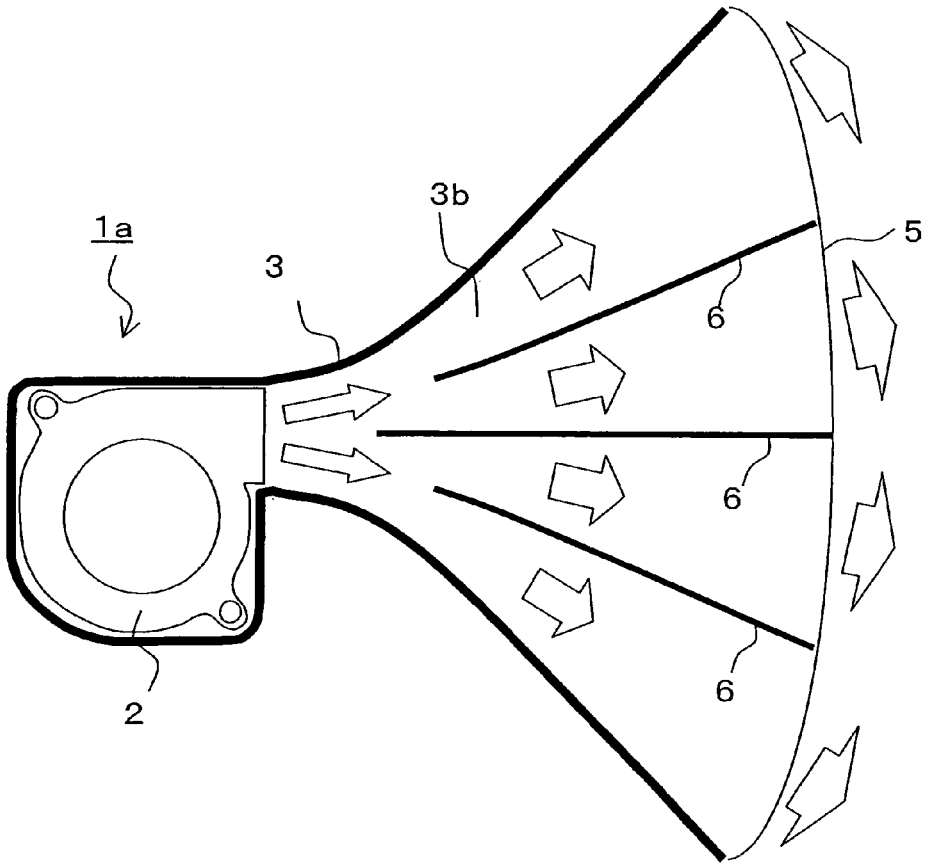
[FIG. 1] A schematic sectional plan view showing a fluid generating apparatus according to a first embodiment of the present invention.

1*a* to 1*e*, 100*a* fluid generating apparatus
2 fluid sending apparatus
3 fluid flowing passage
3*b*, 13*b* enlarged pipe portion
5 blowout opening
6 guiding plate
9 blowout direction changing plate
9*a* rotation shaft
10 fan heater
11*a* to 11*h*, 110*a* to 110*e* ion diffusing apparatus
12 blower
13 wind-blowing path
13*a* narrow portion
13*c* upcurrent flowing passage
14 ion generating apparatus
14*a* electrical discharging surface
15 diffusing apparatus blowout opening
16 wind introducing plate
17 rectifier
19 wind direction changing plate
20*a*, 20*b*, 200 refrigerator
21 door
22 outer-side ion blowout opening
23 radiating section
24 compressor
25 upcurrent
30 microparticle diffusing apparatus
31 water vapor diffusing apparatus
32 water vapor flowing passage
33 water vapor generating apparatus

BEST MODE FOR CARRYING OUT THE INVENTION

Embodiments of the present invention will be explained with reference to the drawings. To simplify the explanation, the same elements of the invention that are the same as those of the conventional technique are designated by the same symbols, and the same elements in each of the embodiments and comparative examples are also designated by the same symbols.

First Embodiment

Figure 2:
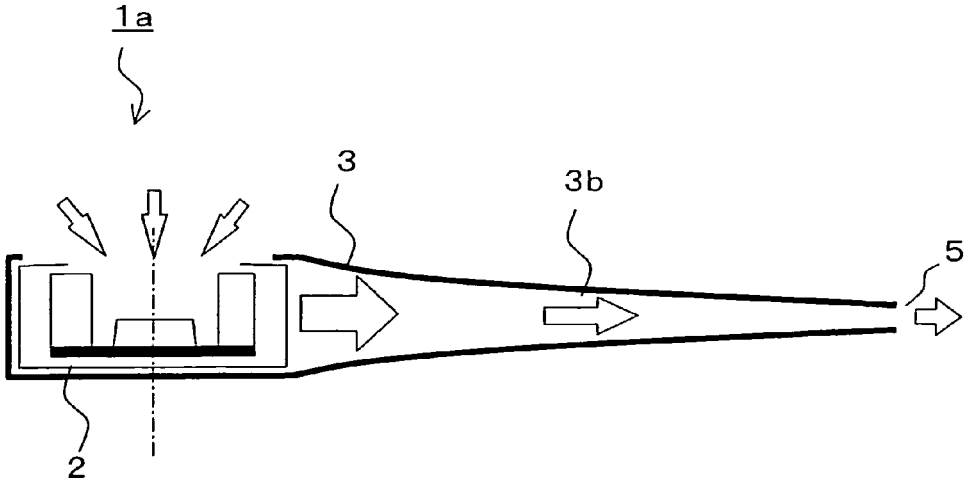
[FIG. 2] A schematic sectional side view showing the fluid generating apparatus according to the first embodiment of the invention.

A first embodiment will be explained. FIG. 1 is a schematic sectional plan view showing a fluid generating apparatus of the first embodiment, and FIG. 2 is a schematic sectional side view showing the fluid generating apparatus of the embodiment. A fluid generating apparatus 1*a* of this embodiment includes a fluid sending apparatus 2 which sends out fluid such as gas and liquid, a fluid flowing passage 3 which transmits the fluid sent out from the fluid sending apparatus 2, a blowout opening 5 formed in an end of the fluid flowing passage 3 for sending out the fluid as a jet stream, and a control section (not shown). The fluid is transmitted by the operation of the fluid sending apparatus 2, flows through the fluid flowing passage 3 and is emitted outside from the blowout opening 5 as the jet stream. In the drawings, arrows show a flow of the fluid.

In the fluid flowing passage 3, upstream portions of the blowout opening 5 comprise enlarged pipe portions 3*b*. The enlarged pipe portion 3*b* is designed such that as the fluid flows toward the blowout opening 5, a height of the enlarged pipe portion 3*b* is gradually reduced and its width is gradually increased, and a cross-sectional area is smoothly increased. In a start point of the fluid flowing passage 3 immediately after the fluid sending apparatus 2, a cross section shape of the enlarged pipe portion 3*b* is set such that the height is 45 mm, the width is 45 mm, i.e., the aspect ratio AR is 1. In the end of the fluid flowing passage 3, i.e., in the blowout opening 5, the height is set to 10 mm, the width is set to 360 mm, i.e., the aspect ratio AR is 36.

Here, the aspect ratio is a ratio between parameters of lengths which determine the cross section shape, and is a value determined by the aspect ratio AR=(longer parameter)/(shorter parameter). Therefore, in the case of a rectangular cross section, the aspect ratio AR=(long side)/(short side), and in the case of an elliptic cross section, the aspect ratio AR=(long diameter)/(short diameter). For example, in the case of a square cross section, the aspect ratio AR is 1, and in the case of a rectangular cross section in which a ratio between the long side and the short side is 2:1, the aspect ratio AR is 2. In the case of a perfect circular cross section, the aspect ratio AR is 1. Thus, the aspect ratio in the present specification is always 1 or more.

The enlarged pipe portion 3*b* is provided with a plurality of guiding plates 6 from a portion thereof immediately downstream of the fluid sending apparatus 2 to a slightly upstream portion of the blowout opening 5. The interior of the enlarged pipe portion 3*b* is divided into a plurality of pieces by the guiding plates 6. In this embodiment, the enlarged pipe portion 3*b* is divided into four pieces by the three guiding plates 6. Each of the divided fluid flowing passages 3 is designed such that its aspect ratio is increased toward the blowout opening 5, and the aspect ratio AR at the end of the guiding plate 6 close to the blowout opening 5 is set to about 9. The three guiding plates 6 are disposed such that the flow rate distribution in any portions of the blowout opening 5 the longitudinal direction is substantially the same. Therefore, the flow rate distribution in the longitudinal direction immediately after the blowout opening 5 is substantially the same in any portions of the blowout opening 5.

Figure 3:
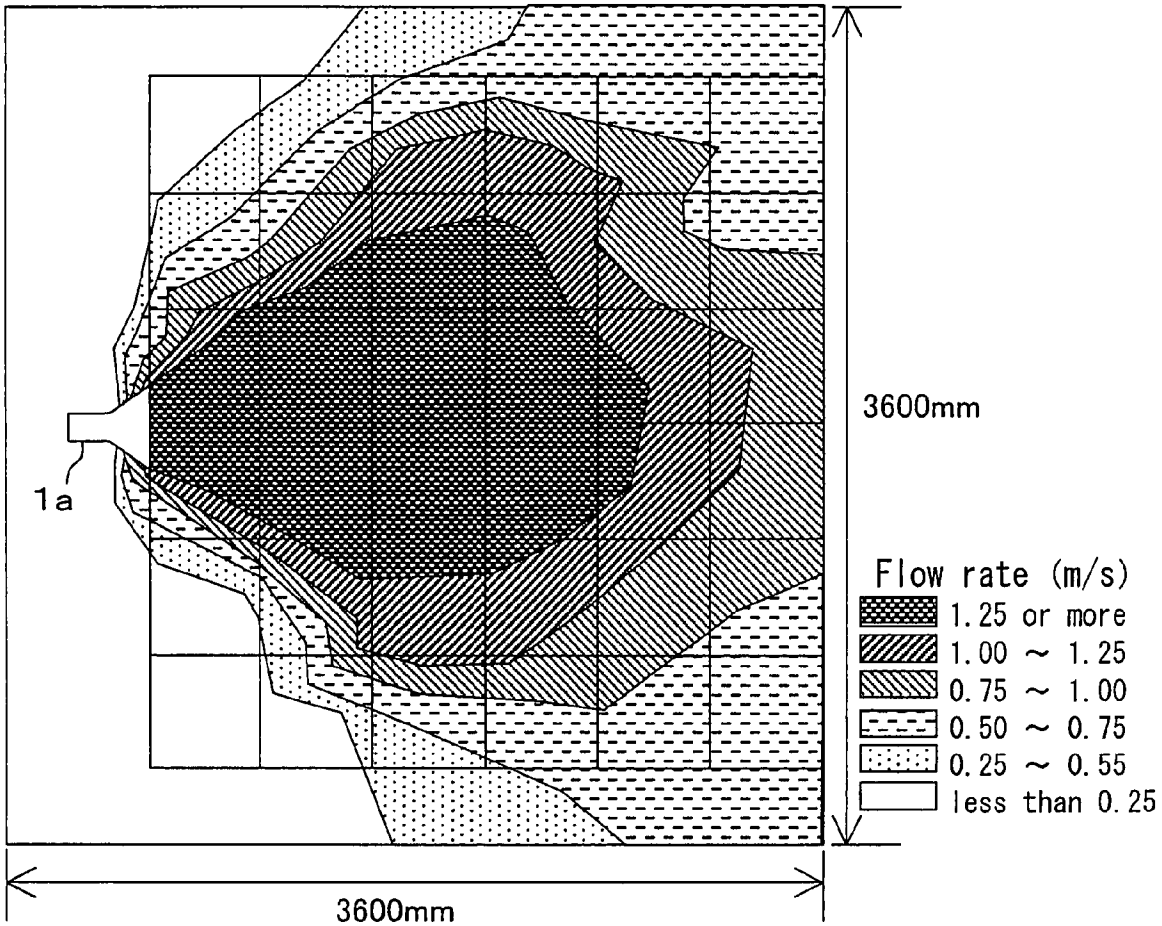
[FIG. 3] A flow rate distribution when the fluid generating apparatus according to the first embodiment of the invention is operated.

As a using example of the fluid generating apparatus 1*a*, FIG. 3 shows the flow rate distribution when air having blowout flow rate of 1.5 m/s is sent. In FIG. 3, one block in the lattice has 0.5 m. Even if the fluid sent from the blowout opening is liquid, substantially the same tendency is qualitatively seen. It is apparent from the comparison with the using example (see FIG. 34) of a fluid generating apparatus 100*a* of a later-described comparative example 1 that, according to FIG. 3, the spray travel distance of fluid sent from the blowout opening 5 is increased, and fluid having high flow rate can be transmitted in a wide region.

Figure 4:
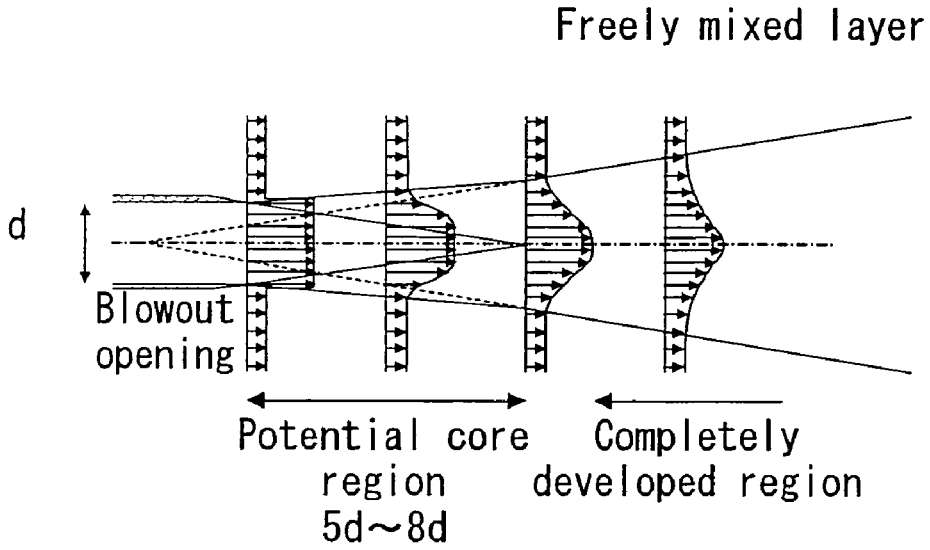
[FIG. 4] A schematic diagram for explaining a potential core.

A mechanism in which the ability of the fluid generating apparatus 1*a* of the embodiment is largely enhanced as compared with the fluid generating apparatus 100*a* of the comparative example 1 will be explained below. The flow rate of the jet stream is attenuated immediately after the fluid is discharged from the blowout opening 5. The spray travel distance of the jet stream has a bearing on the length of the potential core of the jet stream. FIG. 4 is a schematic diagram for explaining the potential core. Generally, the velocity distribution in a central portion of the jet stream immediately after it is sent out from the blowout opening is uniform. This uniform velocity portion is eroded by a freely mixed layer which develops from opposite sides and is reduced and eliminated at a certain distance. This portion is of a wedge shape, and is called the potential core. In the case of a free jet stream flowing out in the stationary fluid, the length of the potential core is varied depending upon the shape of the blowout opening, a state of a boundary layer along a wall surface of the blowout opening and an initial disturbance, but it is known that in the case of two dimensional turbulent flow, the length of the potential core is about 5 to 7 times of the height or diameter of the blowout opening, and in the case of an axial symmetric turbulent flow jet stream, the length of the potential core is about 5 to 8 times of the height or diameter of the blowout opening. As the length of the potential core is increased, the spray travel distance of the jet stream is elongated.

In the fluid generating apparatus 1*a* of this embodiment, the aspect ratio of the blowout opening 5 is optimized to elongate the potential core of the jet stream, thereby suppressing the attenuation of the flow rate. Therefore, the spray travel distance of fluid is largely elongated as compared with the conventional technique (comparative example 1). For example, if the height of the blowout opening 5 is set to a constant value and a lateral width thereof is set to an infinite length, the two dimensional turbulent flow jet stream is obtained as already explained, and the potential core length becomes about 5 to 7 times of the height or diameter of the blowout opening. If the height and the lateral width of the blowout opening are set to the same value (AR=1), the jet stream becomes the same as the axial symmetric turbulent flow jet stream, and the potential core length becomes about 5 to 8 times of the height and the lateral width of the blowout opening. If the aspect ratio of the blowout opening 5 is optimized and the lateral width of the blowout opening 5 is appropriately set with respect to the height of the blowout opening 5, since the potential core length is influenced not only by the height of the blowout opening but also by the lateral width of the blowout opening, the potential core length becomes about 5 to 8 times of the average value of the height and width of the blowout opening, and the length is remarkably elongated as compared with the two dimensional turbulent flow jet stream or the axial symmetric turbulent flow jet stream of the blowout opening having the same height.

Figure 5:
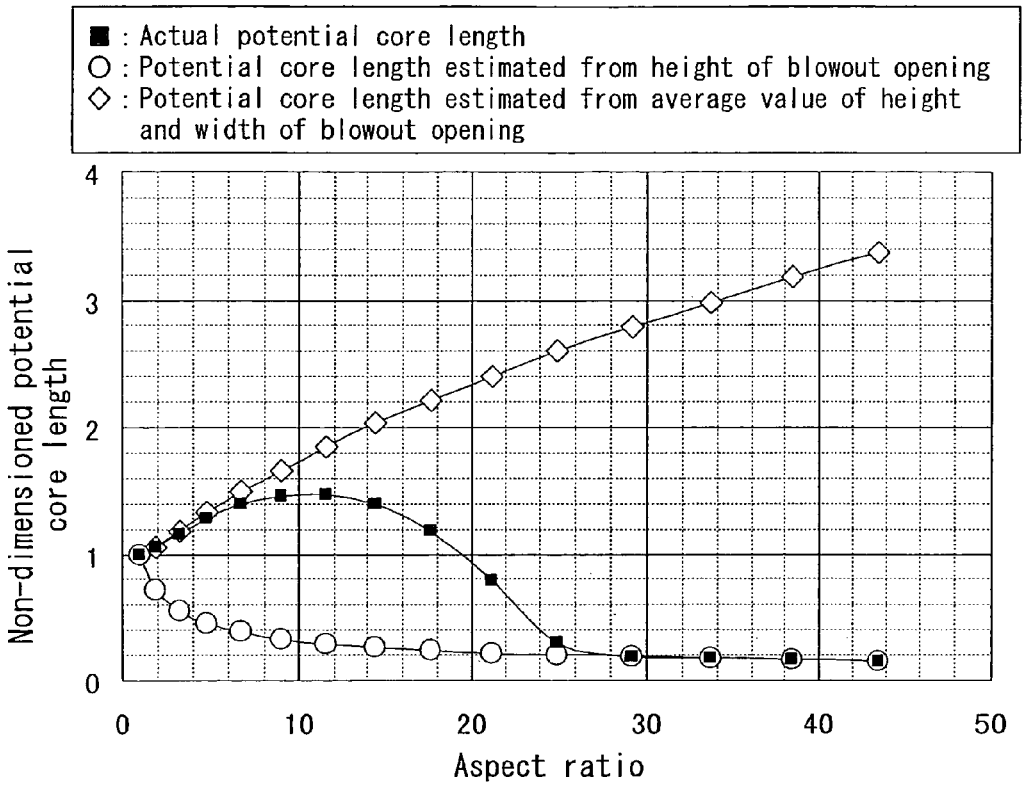
[FIG. 5] A relation between a potential core length and an aspect ratio of a cross section in the vicinity of a blowout opening when a cross-sectional area is constant.
Figure 6:
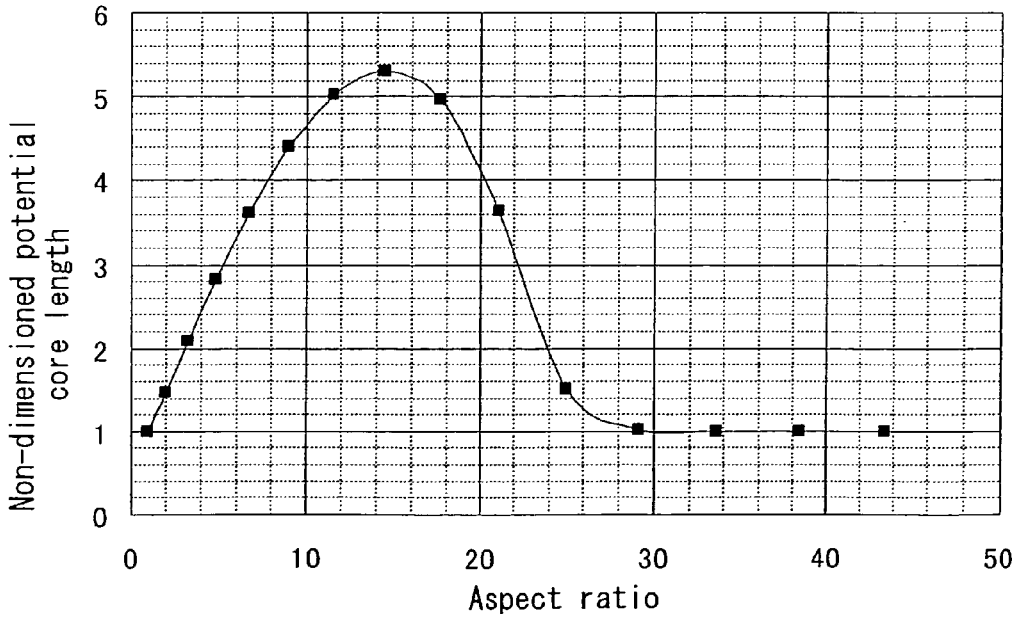
[FIG. 6] A relation between the potential core length and the aspect ratio of the cross section in the vicinity of the blowout opening when a height is constant.

FIGS. 5 and 6 show the relation between the aspect ratio and the potential core length of the cross section in the vicinity of the blowout opening 5 in the fluid generating apparatus 1*a* of this embodiment. Black quadrate marks in FIG. 5 show non-dimensioned values obtained by dividing a potential core length when the blowout flow rate, discharging flow rate and the area of the blowout opening are fixed and the aspect ratio (blowout opening width/blowout opening height) is varied, by a potential core length when the aspect ratio becomes 1 (blowout opening is of square). White circular marks in FIG. 5 show non-dimensioned values obtained by dividing a potential core length estimated from the height of the blowout opening by a potential core length when the aspect ratio becomes 1. White rhomboidal marks in FIG. 5 show non-dimensioned value obtained by dividing a potential core length estimated from the average value of the height and the width of the blowout opening by a potential core length when the aspect ratio becomes 1.

FIG. 5 shows characteristics that the actual potential core length is closely analogous to a value estimated from the average value of the height and the width of the blowout opening when the aspect ratio is up to about 5, and when the aspect ratio becomes 30 or more, the jet stream becomes the two dimensional turbulent flow jet stream, the potential core length becomes closely analogous to a value estimated from the height of the blowout opening, and in a region where the aspect ratio is 5 to 30, the above-mentioned two estimated values are smoothly connected to each other. In FIG. 5, when the aspect ratio is 2 or more, the non-dimensioned potential core length gains the superiority over the aspect ratio 1, and when the aspect ratio is 20 or more, the non-dimensioned potential core length loses the superiority ($2 \leqq AR \leqq 20$).

In FIG. 6, black quadrate marks show non-dimensioned values obtained by dividing a potential core length when the blowout flow rate and the height of the blowout opening are fixed and the aspect ratio is varied, by a potential core length when the aspect ratio is 1 (blowout opening is square in shape). In this case, as the aspect ratio is increased, the area of the blowout opening and the blowout flow rate are increased. According to FIG. 6, it can be found that the jet stream becomes the two dimensional turbulent flow jet stream from the non-dimensioned potential core length when the aspect ratio is 30 or more. When the aspect ratio is 1 or more, the non-dimensioned potential core length gains the superiority over the aspect ratio 1, and when the aspect ratio is 30 or more, the non-dimensioned potential core length loses the superiority. Further remarkable superiority appears when the non-dimensioned potential core length is 3 or more, and the aspect ratio at that time is in a range of $5 \leqq AR \leqq 22$.

Therefore, the range of $5 \leqq AR \leqq 20$ which satisfies both the range ($2 \leqq AR \leqq 20$) of the aspect ratio obtained from FIG. 5 and the range ($5 \leqq AR \leqq 22$) of the aspect ratio obtained from FIG. 6 will be the most suitable aspect ratio. The values and characteristics shown in FIGS. 5 and 6 are slightly varied, in some cases, depending upon the kinds (properties) of fluid, shape of the blowout opening, a state of a boundary layer along the wall surface of the blowout opening, the initial disturbance and the like.

That is, if the area of the blowout opening and the flow rate of the blowout opening are the same, i.e., if the flow rates are the same, the potential core length, i.e., the spray travel distance of fluid can be elongated by optimizing the aspect ratio of the blowout opening 5. In other words, when the potential core lengths are the same, i.e., when the spray travel distances of fluid are the same, since the flow rate can be reduced, the electricity to be consumed of the fluid sending apparatus 2 and the noise value can be reduced.

It is preferable that the cross-sectional areas of the end points of the fluid flowing passage 3 and the enlarged pipe portion 3*b* are set greater as compared with cross-sectional areas of the start points thereof. In this embodiment, the fluid flowing passage 3 and the enlarged pipe portion 3*b* are designed such that they have functions of diffusers. Therefore, the kinetic energy of fluid can be converted into static pressure, and this can assist the ability of the fluid sending apparatus 2. Thus, the flow rate is increased and the noise is reduced as compared with a case in which all of pressure loss generated when the fluid passes through various portions is applied to the fluid sending apparatus 2.

It is preferable that the aspect ratio of the fluid sending apparatus 2, i.e., the aspect ratio of the start point of the fluid flowing passage 3 is equal to or more than 2, but even when the aspect ratio of the start point of the fluid flowing passage 3 is great, if the aspect ratio of the cross section of the end point of the fluid flowing passage 3 is set to $5 \leqq AR \leqq 20$, or the fluid flowing passage 3 is divided by the guiding plates 6 and the aspect ratio of the cross section of the fluid flowing passage 3 at the end of the guiding plate 6 on the side of the blowout opening 5 is set to $5 \leqq AR \leqq 20$, the effect close to that described above can be obtained.

Second Embodiment

Figure 7:
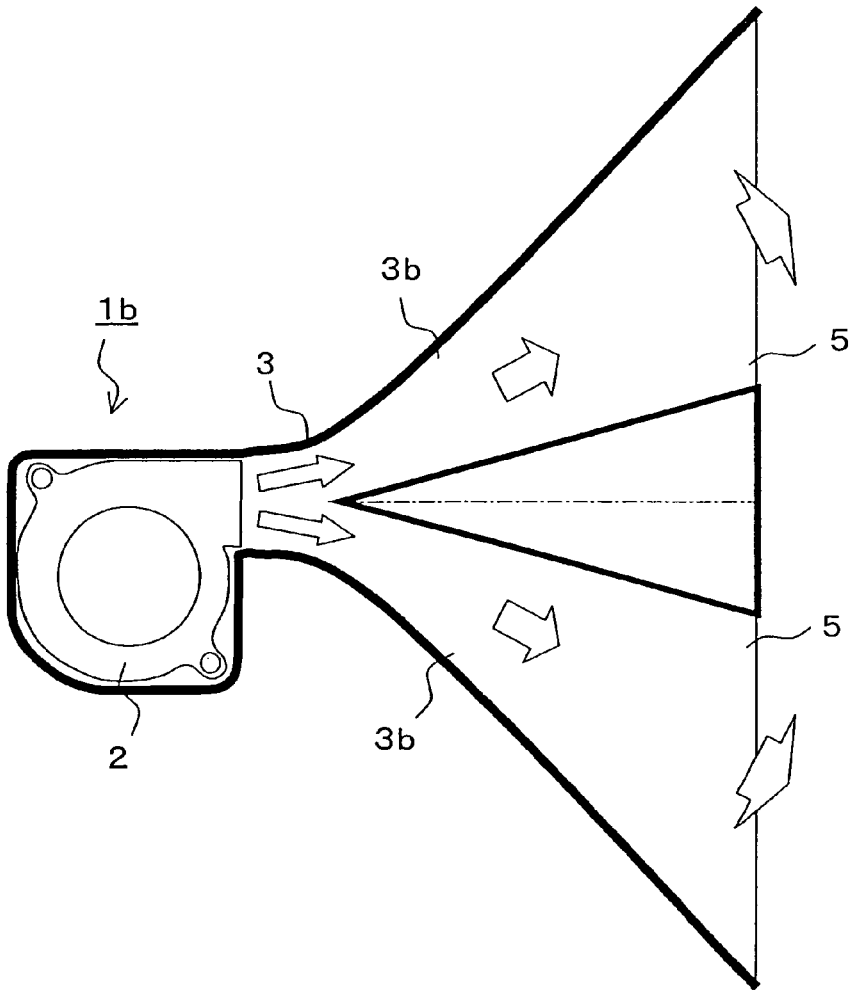
[FIG. 7] A schematic sectional plan view showing a fluid generating apparatus according to a second embodiment of the invention.
Figure 8:
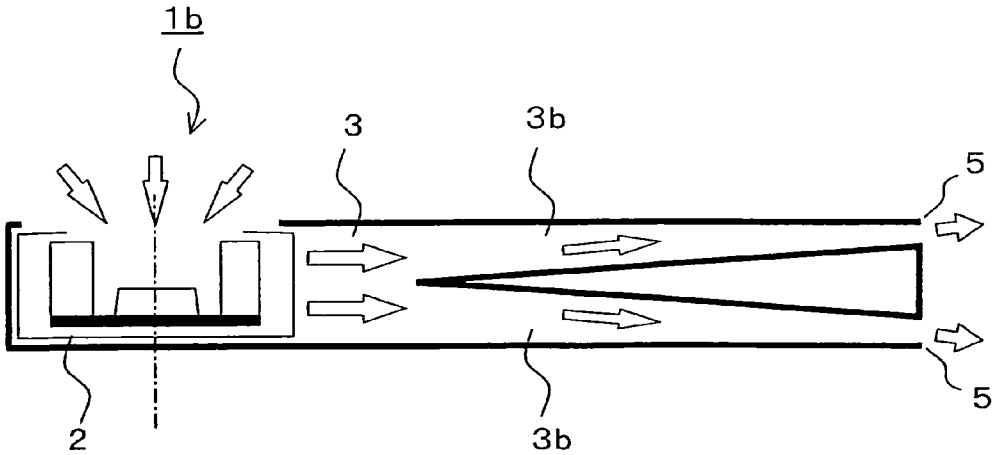
[FIG. 8] A schematic sectional side view showing the fluid generating apparatus according to the second embodiment of the invention.

A second embodiment will be explained next. FIG. 7 is a schematic sectional plan view showing a fluid generating apparatus according to the second embodiment, and FIG. 8 is a schematic sectional side view showing the fluid generating apparatus according to the second embodiment.

In the second embodiment, the guiding plates 6 of the first embodiment are omitted, and the fluid flowing passage 3 is divided by a plurality of enlarged pipe portions 3*b* from the downstream portion immediately after the fluid sending apparatus 2. In this embodiment, the fluid flowing passage 3 is divided into two enlarged pipe portions 3*b* in the lateral direction and two enlarged pipe portions 3*b* in the vertical direction, i.e., the fluid flowing passage 3 is divided into total four enlarged pipe portions 3*b* and thus, four blowout openings 5 are provided. The divided fluid flowing passage 3 and their enlarged pipe portions 3*b* are designed such that the aspect ratios are increased as they approach the blowout opening 5, and the aspect ratio thereof at the position of the blowout opening 5 is set to about 10. Other structures are the same as those of the first embodiment.

The fluid generating apparatus 1*b* of this embodiment has a different flow rate distribution as compared with that of the first embodiment. That is, the spray travel distance of the jet stream forward of the fluid generating apparatus 1*b* is slightly shorter, but the transfer region of the jet stream in the vertical direction in a forward space of the fluid generating apparatus 1*b* can be increased.

Figure 9:
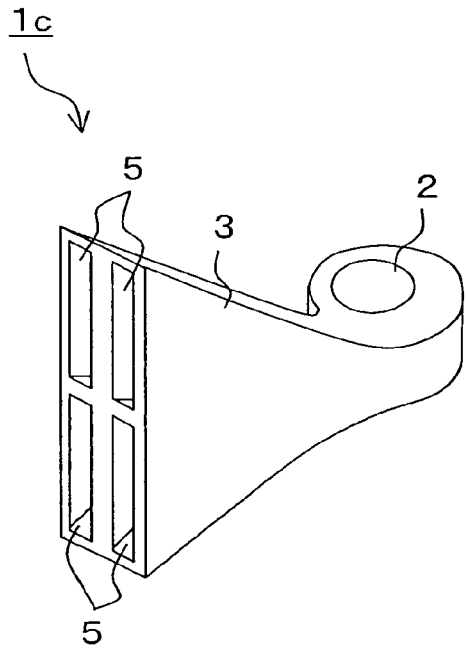
[FIG. 9] A perspective view showing another fluid generating apparatus of the second embodiment of the invention.

The shape of the blowout opening 5 need not have the relation of height<width. FIG. 9 is a perspective view showing another fluid generating apparatus of the second embodiment. The shape of the blowout opening 5 of the fluid generating apparatus 1*c* has the relation of height>width. The fluid flowing passage 3 is divided into two enlarged pipe portions 3*b* in the lateral direction and two enlarged pipe portions 3*b* in the vertical direction, i.e., the fluid flowing passage 3 is divided into total four enlarged pipe portions 3*b* and thus, four blowout openings 5 are provided. The divided fluid flowing passage 3 and their enlarged pipe portions 3*b* are designed such that the aspect ratios are increased as they approach the blowout opening 5, and the aspect ratio thereof at the position of the blowout opening 5 is set to about 10. Other structures are the same as those of the fluid generating apparatus 1*b*. The fluid generating apparatus 1*c* has a flow rate distribution different from that of the fluid generating apparatus 1*b*. That is, the spray travel distance of the jet stream forward of the fluid generating apparatus 1*c* is the same, the transfer region of the jet stream in the vertical direction in the forward space of the fluid generating apparatus 1*c* is largely increased, and the transfer region of the jet stream in the lateral direction is reduced.

It is preferable that the aspect ratio of the fluid sending apparatus 2, i.e., the aspect ratio of the start point of the fluid flowing passage 3 is equal to or more than 2, but even when the aspect ratio of the start point of the fluid flowing passage 3 is great, if the aspect ratio of the cross section of the end point of the fluid flowing passage 3 is set to $5 \leqq AR \leqq 20$, or the fluid flowing passage 3 is divided by the guiding plates 6 and the aspect ratio of the cross section of the fluid flowing passage 3 at the end of the guiding plate 6 on the side of the blowout opening 5 is set to $5 \leqq AR \leqq 20$, the effect close to that described above can be obtained.

Third Embodiment

Figure 10:
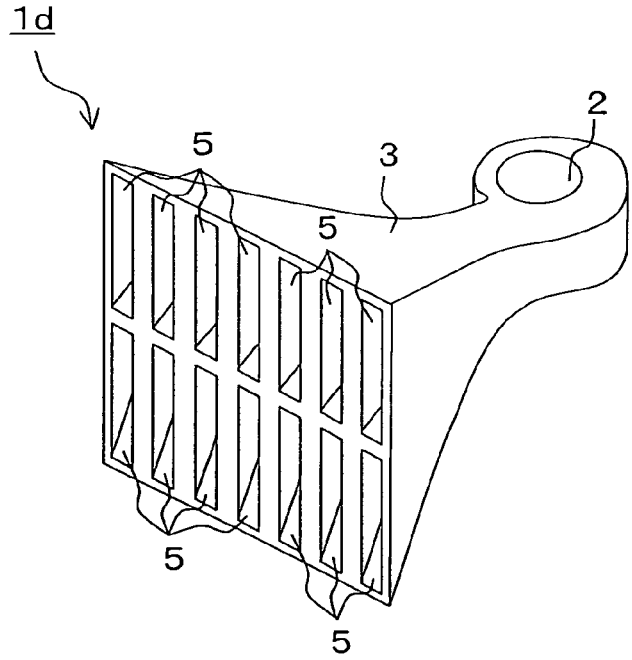
[FIG. 10] A perspective view showing a fluid generating apparatus according to a third embodiment of the invention.

A third embodiment will be explained next. FIG. 10 is a perspective view showing a fluid generating apparatus of the third embodiment.

Like the other embodiment in the second embodiment, the shape of the blowout opening 5 of a fluid generating apparatus 1*d* of the third embodiment has the relation of height>width. The fluid flowing passage 3 is divided into seven enlarged pipe portions 3*b* in the lateral direction and two enlarged pipe portions 3*b* in the vertical direction, i.e., the fluid flowing passage 3 is divided into total fourteen enlarged pipe portions 3*b* and thus, fourteen blowout openings 5 are provided. The divided fluid flowing passage 3 and their enlarged pipe portions 3*b* are designed such that the aspect ratios are increased as they approach the blowout opening 5, and the aspect ratio thereof at the position of the blowout opening 5 (in this case, height of the blowout opening/width of the blowout opening) is set to about 8. Other structures are the same as those of the other embodiment of the second embodiment.

In the fluid generating apparatus 1*d*, the flow rate distribution is different from the other embodiment of the second embodiment. That is, the spray travel distance of the jet stream forward of the fluid generating apparatus 1*b* is slightly shorter, the transfer region of the jet stream in the vertical direction in a forward space of the fluid generating apparatus 1*d* is substantially the same, and the transfer region of the jet stream in the lateral direction is largely increased. That is, it is possible to transfer the jet stream into the region which is wide in the vertical direction and the lateral direction forward of the fluid generating apparatus 1*d*.

Fourth Embodiment

Figure 11:
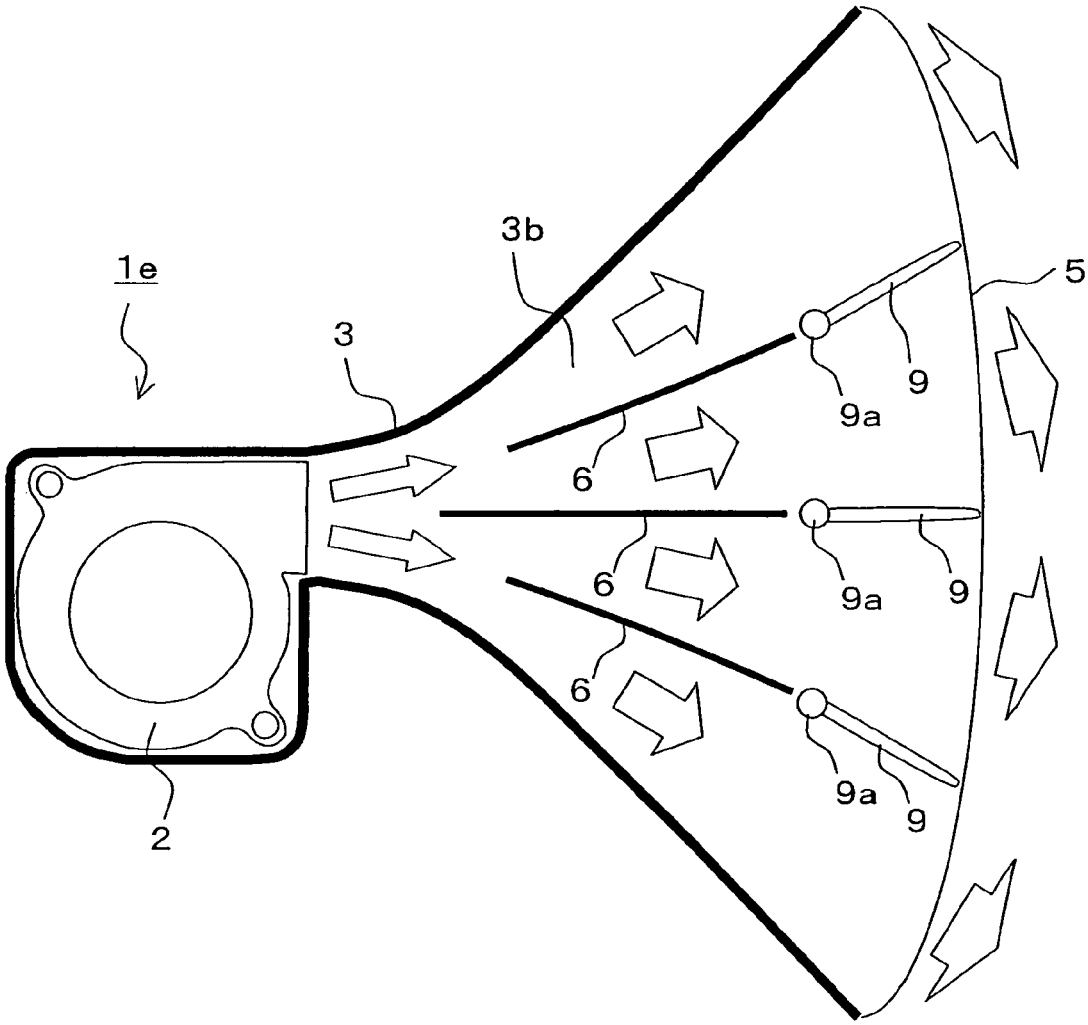
[FIG. 11] A schematic sectional side view showing a fluid generating apparatus according to a fourth embodiment of the invention.

A fourth embodiment will be explained next. FIG. 11 is a schematic sectional side view showing a fluid generating apparatus according to the fourth embodiment.

In a fluid generating apparatus 1*e* of this embodiment, a plurality of blowout direction changing plates 9 which turn in association are added in the vicinity of the blowout opening 5 of the first embodiment. If the direction of the blowout direction changing plates 9 is changed, the blowout direction of the fluid can be changed. Other structure is the same as that of the first embodiment.

Figure 12:
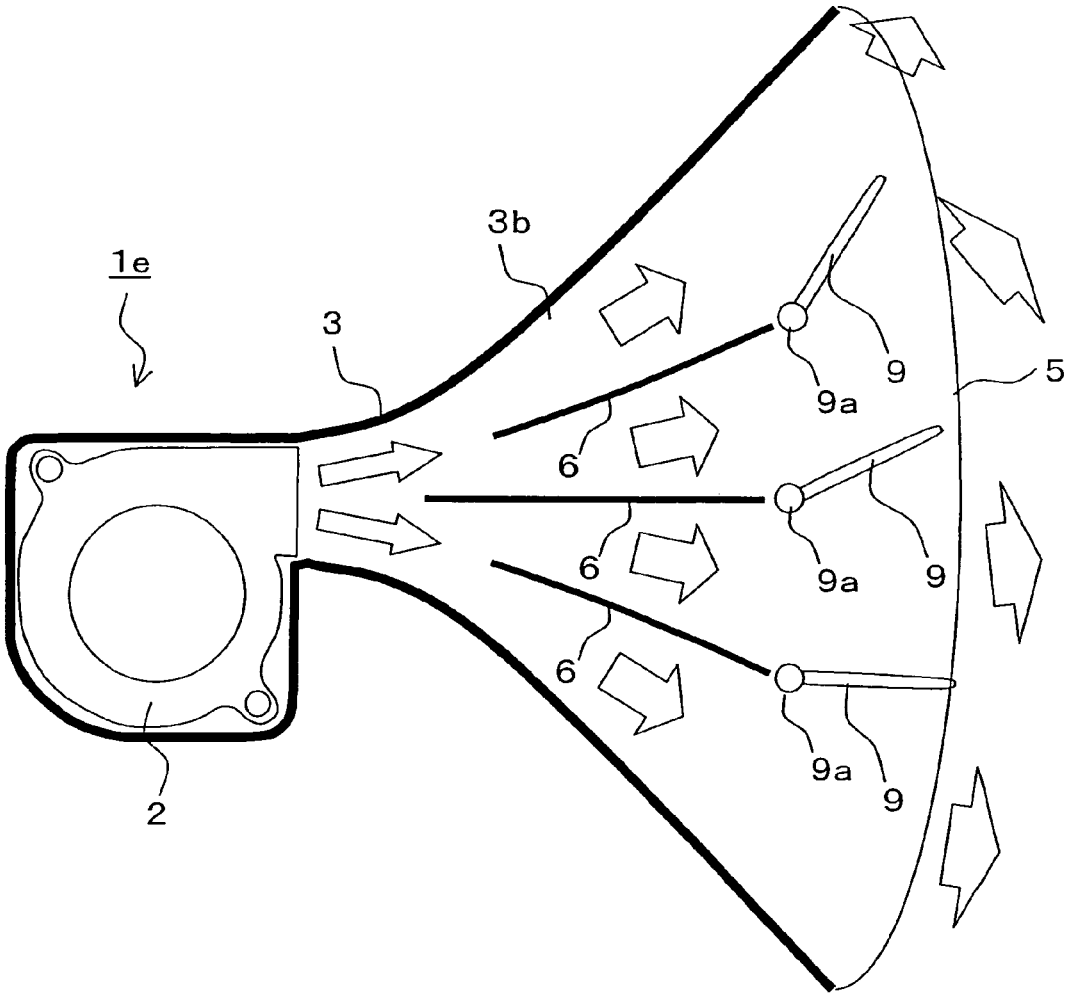
[FIG. 12] A schematic sectional plan view showing the operation of a blowout direction changing plate of the fluid generating apparatus according to the fourth embodiment of the invention.

If the direction of the plurality of blowout direction changing plates 9 is changed around a rotation shaft 9*a* as shown in FIG. 12 for example, the jet stream can be intensively dispersed in a desired direction or can be dispersed in a wide range. An apparatus having the fluid generating apparatus 1*e* can not effectively disperse the jet stream due to its wall surface or obstacles depending upon the installation place of the apparatus in some cases. In the case of the fluid generating apparatus 1*e* of this embodiment, however, the influence of the wall surface or obstacle can be reduced to some extent by changing the direction of the blowout direction changing plate 9.

Fifth Embodiment

Figure 13:
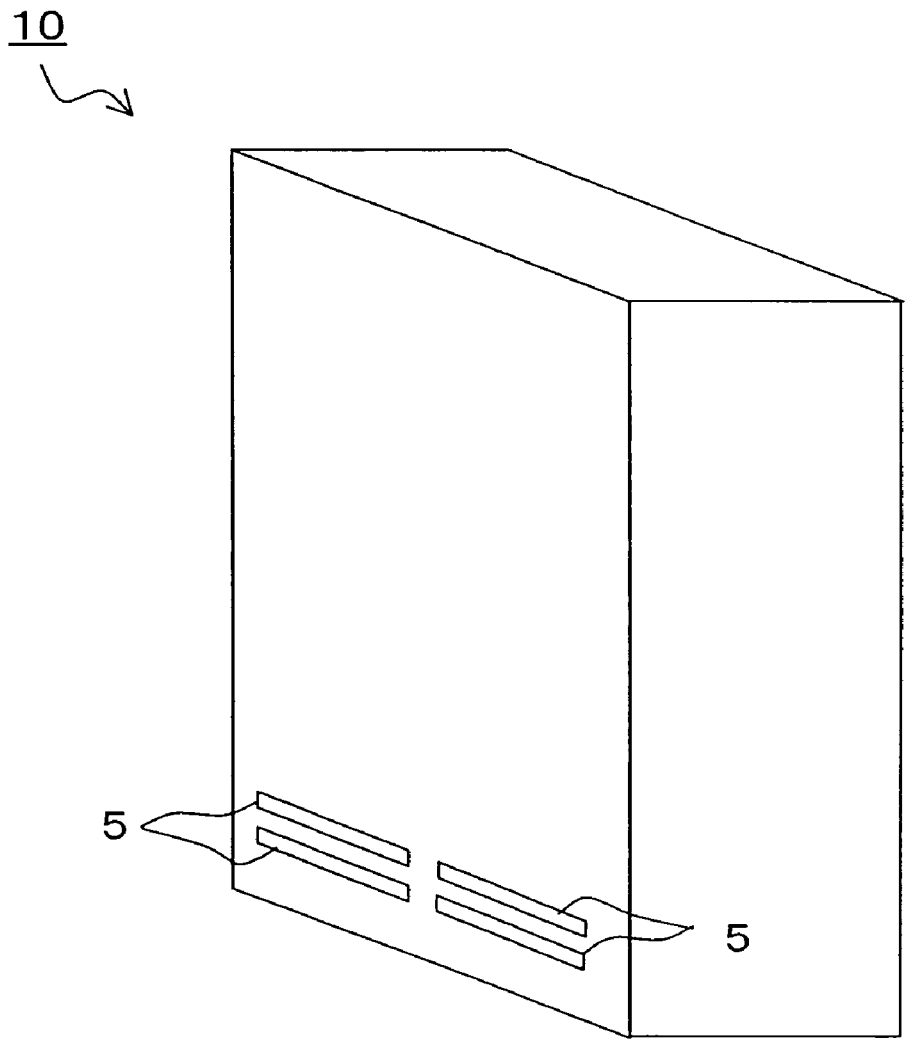
[FIG. 13] A perspective view of a fan heater according to a fifth embodiment of the invention.

A fifth embodiment will be explained next. FIG. 13 is a perspective view of a fan heater 10 according to the fifth embodiment. The fan heater 10 includes the fluid generating apparatus 1*b* of the second embodiment.

Generally, warm air discharged from the fan heater is brought upward largely due to a buoyant force as the wind velocity is attenuated and thus, the spray travel distance is shortened. Since the fan heater 10 of this embodiment has the fluid generating apparatus 1*b* of the second embodiment, the attenuation of the wind velocity is suppressed, and the upward blowing of the warm air is suppressed and thus, the warm air currents along the floor surface. With this, the comfort of the fan heater is largely enhanced, and the amount of wind can be reduced and thus, the noise is small.

As another embodiment of the fifth embodiment, the fluid generating apparatus 1*b* of the fan heater 10 is changed to the fluid generating apparatus 1*a* of the first embodiment shown in FIGS. 1 and 2. In this case, the flow rate distribution of the warm air is different from that of the fifth embodiment. That is, the forward spray travel distance of the warm air of the fan heater 10 is slightly elongated, and the transfer region of warm air in the vertical direction in the forward space of the fan heater 10 is reduced.

As another embodiment of the fifth embodiment, the fluid generating apparatus 1*b* of the fan heater 10 is changed to the fluid generating apparatus 1*c* of the other embodiment of the second embodiment shown in FIG. 9. In this case, the flow rate distribution of warm air is different from that of the fifth embodiment. That is, the forward spray travel distance of warm air of the fan heater 10 is the same, the transfer region of warm air in the vertical direction in the forward space of the fan heater 10 is largely increased, and the transfer region of warm air in the lateral direction is reduced.

Sixth Embodiment

Figure 14:
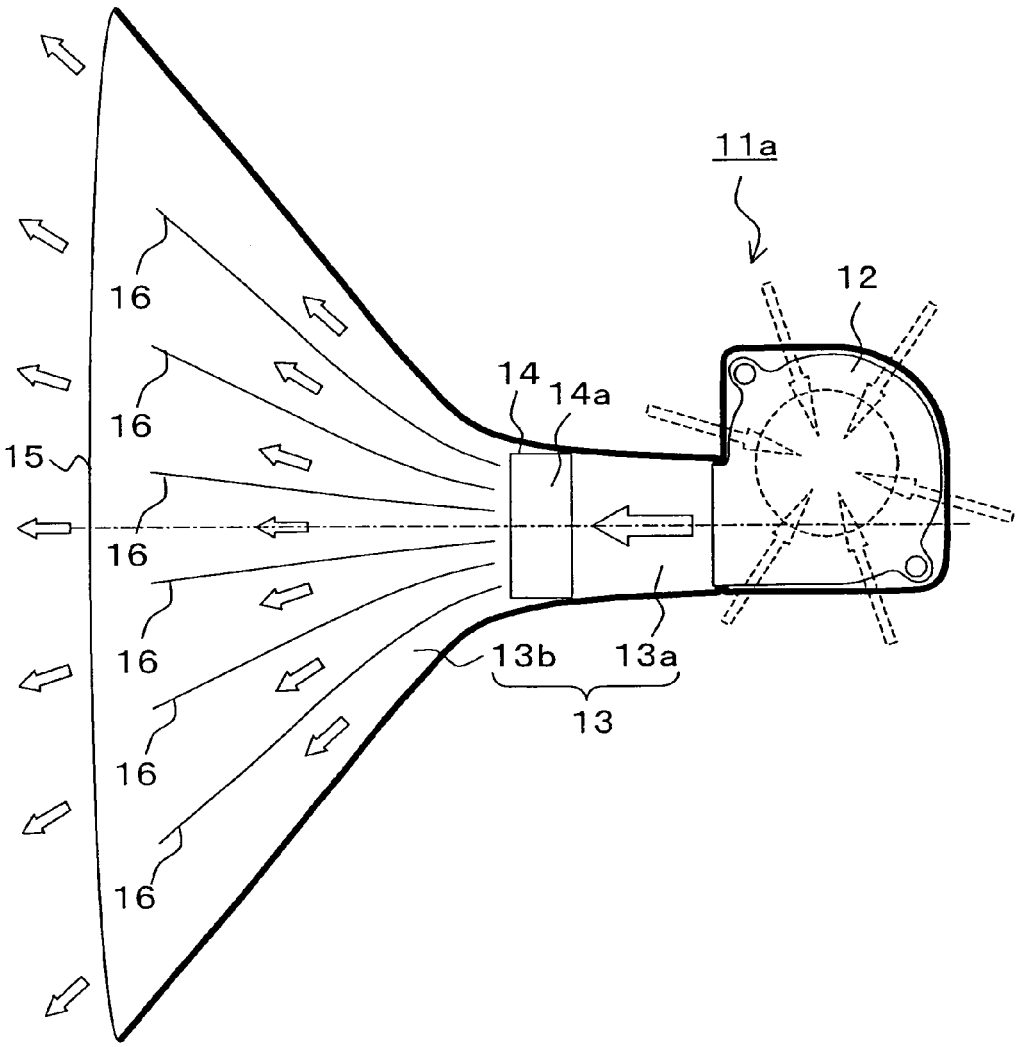
[FIG. 14] A schematic sectional plan view showing an ion diffusing apparatus according to a sixth embodiment of the invention.
Figure 15:
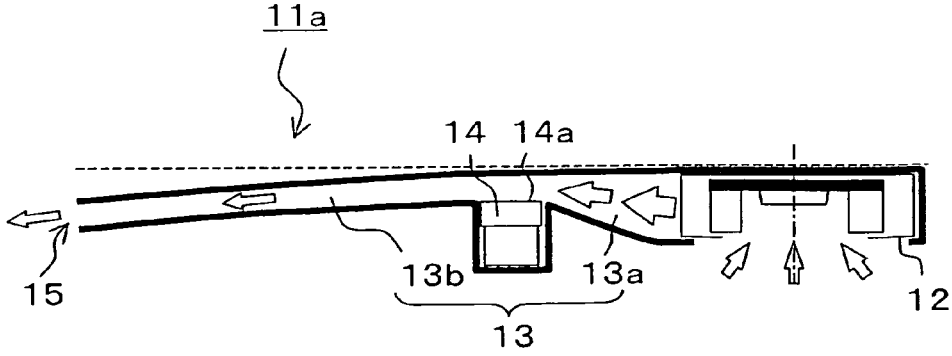
[FIG. 15] A schematic sectional side view showing the ion diffusing apparatus according to the sixth embodiment of the invention.
Figure 16:
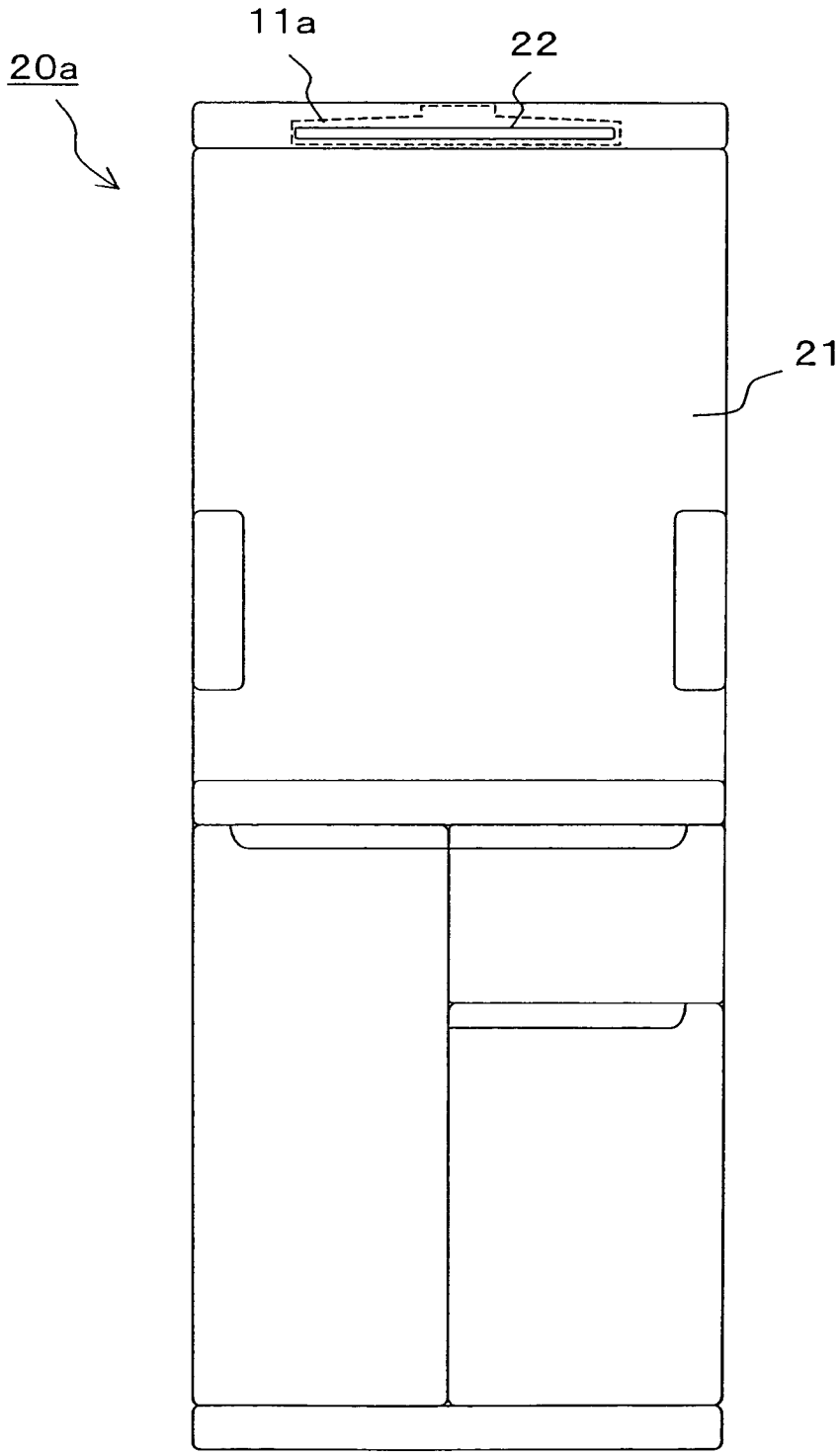
[FIG. 16] A front view of a refrigerator having the ion diffusing apparatus according to the sixth embodiment of the invention.

A sixth embodiment will be explained. FIG. 14 is a schematic sectional plan view showing an ion diffusing apparatus according to the sixth embodiment, FIG. 15 is a schematic sectional side view showing the ion diffusing apparatus according to the embodiment, and FIG. 16 is a front view of a refrigerator having the ion diffusing apparatus according to this embodiment.

The ion diffusing apparatus 11*a* of this embodiment comprises a blower 12, a wind-blowing path 13, an ion generating apparatus 14 disposed such that its electrical discharging surface 14*a* faces the wind-blowing path 13, and a control section (not shown). Ions are produced by the operation of the ion generating apparatus 14. The ions are transferred by the operation of the blower 12, flows through the wind-blowing path 13, and are discharged outside from a diffusing apparatus blowout opening 15. Arrows in FIGS. 14 and 15 show a state of air current at this time.

A door 21 is provided on a front surface of a refrigerator 20*a*. The door 21 is provided at its upper portion with an outer-side ion blowout opening 22 which is in communication with the wind-blowing path 13 and the diffusing apparatus blowout opening 15 so that ions are discharged and dispersed outside of the refrigerator. An air filter (not shown) is disposed at an upstream portion of a suction opening of the blower 12 so as to prevent greasy fumes and dust from entering into the ion diffusing apparatus 11*a*.

The ion generating apparatus 14 can generate ions which become $H^+(H_2O)_n$ and $O_2^-(H_2O)_m$, and can switch between a mode for generating more minus ions than plus ions, a mode for generating more plus ions than minus ions, and a mode for generating the same amounts of minus ions and plus ions in accordance with its using object. Ions generated from the electrical discharging surface 14*a* of the ion generating apparatus 14 are discharged into the wind-blowing path 13, and are discharged out from the refrigerator from the diffusing apparatus blowout opening 15 and the outer-side ion blowout opening 22 by the operation of the blower 12.

Especially when the same amounts of plus ions ($H^+(H_2O)_n$ or the like) and minus ions ($O_2^-(H_2O)_m$ or the like) are to be generated by the ion generating apparatus 14, $H^+(H_2O)_n$ and $O_2^-(H_2O)_m$ discharged outside of the refrigerator are agglutinated on surfaces of microorganisms, and surround floating germs such as microorganisms in the air. These ions are concentrated and produced on the surfaces of [.OH] (hydroxyl radical) or $H_2O_2$ (hydrogen peroxide) which are active species by collision as shown in the following formulae (1) to (3), thereby sterilizing the floating germs.

$$H^+(H_2O)_n+O_2^-(H_2O)_m \rightarrow .OH+\tfrac{1}{2}O_2+(n+m)H_2O \quad (1)$$

$$H^+(H_2O)_n+H^+(H_2O)_{n'}+O_2^-(H_2O)m+O_2^-(H_2O)_{m'} \rightarrow 2.OH+O_2+(n+n'+m+m')H_2O \quad (2)$$

$$H^+(H_2O)_n+H^+(H_2O)_{n'}+O_2^-(H_2O)_m+O_2^-(H_2O)_{m'} \rightarrow H_2O_2+O_2+(n+n'+m+m')H_2O \quad (3)$$

As described above, by discharging the plus ions and minus ions into a living space outside the refrigerator around the forward area of the refrigerator 20*a*, suspended bacteria existing in the living space are sterilized, and sanitary living space can be provided, and it is possible to prevent the suspended bacteria from entering into the refrigerator from the outside when the door 21 is opened or closed, and sanitary inside environment of the refrigerator can be obtained.

The wind-blowing path 13 includes a narrow portion 13*a* and the enlarged pipe portion 13*b*. In the wind-blowing path 13 extending from the blower 12 toward the diffusing apparatus blowout opening 15, the narrow portion 13*a* is provided immediately before the electrical discharging surface 14*a* of the ion generating apparatus 14, and the wind-blowing path 13 which is in communication with the blower 12 has a shape in which a cross-sectional area of the narrow portion 13*a* is smoothly reduced as it approaches the electrical discharging surface 14*a* of the ion generating apparatus 14. The disturbance of air flowing in the vicinity of the electrical discharging surface 14*a* of the ion generating apparatus 14 can be rectified by the narrow portion 13*a*, and the deviation of flow, i.e., a so-called deviated flow generated at downstream of the blower 12 can be suppressed.

If the width of the ion generating apparatus 14 in a direction perpendicular to the flow of the electrical discharging surface 14*a* is defined as w1, and the width of the wind-blowing path 13 facing the electrical discharging surface 14*a* is defined as w2, they are set such that a relation of w2=w1 is established. Therefore, the ion concentration in the wind-blowing path 13 of the downstream portion of the ion generating apparatus 14 becomes substantially uniform in a plane perpendicular to the flowing direction.

If w2 is set greater than 1.3×w1, it is not preferable because the ion concentration is varied in a direction perpendicular to the flow. Especially when the center of the direction perpendicular to the flow of the electrical discharging surface 14*a* of the ion generating apparatus 14 and the center of the wind-blowing path 13 facing the electrical discharging surface 14*a* are set at the same position, the ion concentration is high in the vicinity of the center of the diffusing apparatus blowout opening 15, and the ion concentration is reduced at the opposite ends. If the electrical discharging surface 14*a* is deviated toward one side of the wind-blowing path 13, the ion concentration is high only on the one side of the diffusing apparatus blowout opening 15, and the ion concentration becomes low on the other side.

If w2 is set smaller than 0.7×w1, ions discharged from the electrical discharging surface 14*a* do not go with air current and thus, it is not efficiency. Thus, if w2 is set such that the relation of 0.7×w1≦w2≦1.3×w1, preferably w2=w1 is satisfied, it is possible to efficiently transfer and disperse the ions.

The enlarged pipe portion 13*b* extends from the ion generating apparatus 14 to the diffusing apparatus blowout opening 15. A cross-sectional area of the enlarged pipe portion 13*b* is smoothly increased from the ion generating apparatus 14 toward the diffusing apparatus blowout opening 15. The cross section shape of the enlarged pipe portion 13*b* immediately after the ion generating apparatus 14 has 10 mm in height and 30 mm in width, i.e., the aspect ratio is 3, and at the end point of the enlarged pipe portion 13*b*, i.e., at the diffusing apparatus blowout opening 15, the cross section shape has 8 mm in height and 450 mm in width, i.e., the aspect ratio AR is 56.

The enlarged pipe portion 13*b* is provided with a plurality of wind introducing plates 16 extending from downstream portion of the ion generating apparatus 14 toward the upstream portion of the diffusing apparatus blowout opening 15. The interior of the enlarged pipe portion 13*b* is divided into a plurality of pieces by the wind introducing plates 16. In this embodiment, the enlarged pipe portion 13*b* is divided into seven pieces by six wind introducing plates 16. Each of the divided wind-blowing paths 13 has an aspect ratio which is increased toward the diffusing apparatus blowout opening 15, and the aspect ratio at the end of the wind introducing plate 16 closer to the diffusing apparatus blowout opening 15 is set to about 8. The six wind introducing plates 16 are designed such that the wind velocity distribution in the longitudinal direction at the diffusing apparatus blowout opening 15 is substantially the same in any portion thereof. Thus, the ion concentration of the downstream portion of the diffusing apparatus blowout opening 15 becomes substantially uniform in a plane perpendicular to the direction of flow.

The enlarged pipe portion 13*b* is inclined downward as approaching the diffusing apparatus blowout opening 15. That is, ions are sent out downward with respect to the horizontal plane from the outer-side ion blowout opening 22. In this embodiment, since the outer-side ion blowout opening 22 is disposed at the height of about 1700 mm from the floor surface, it is possible to efficiently disperse the ions into a space outside the refrigerator by sending out the ions downward with respect to the horizontal plane. Microorganisms such as suspended bacteria existing in the space around the refrigerator fall with time by gravity and are accumulated on a lower portion of the space. Therefore, if the ions are sent out downward with respect to the horizontal plane, the microorganisms can efficiently be sterilized. Especially in this embodiment, ions can effectively be dispersed at a position of 1300 mm to 1500 mm in height from the floor surface and thus, it is possible to effectively prevent a user from inhaling the microorganisms such as virus.

Figure 17:
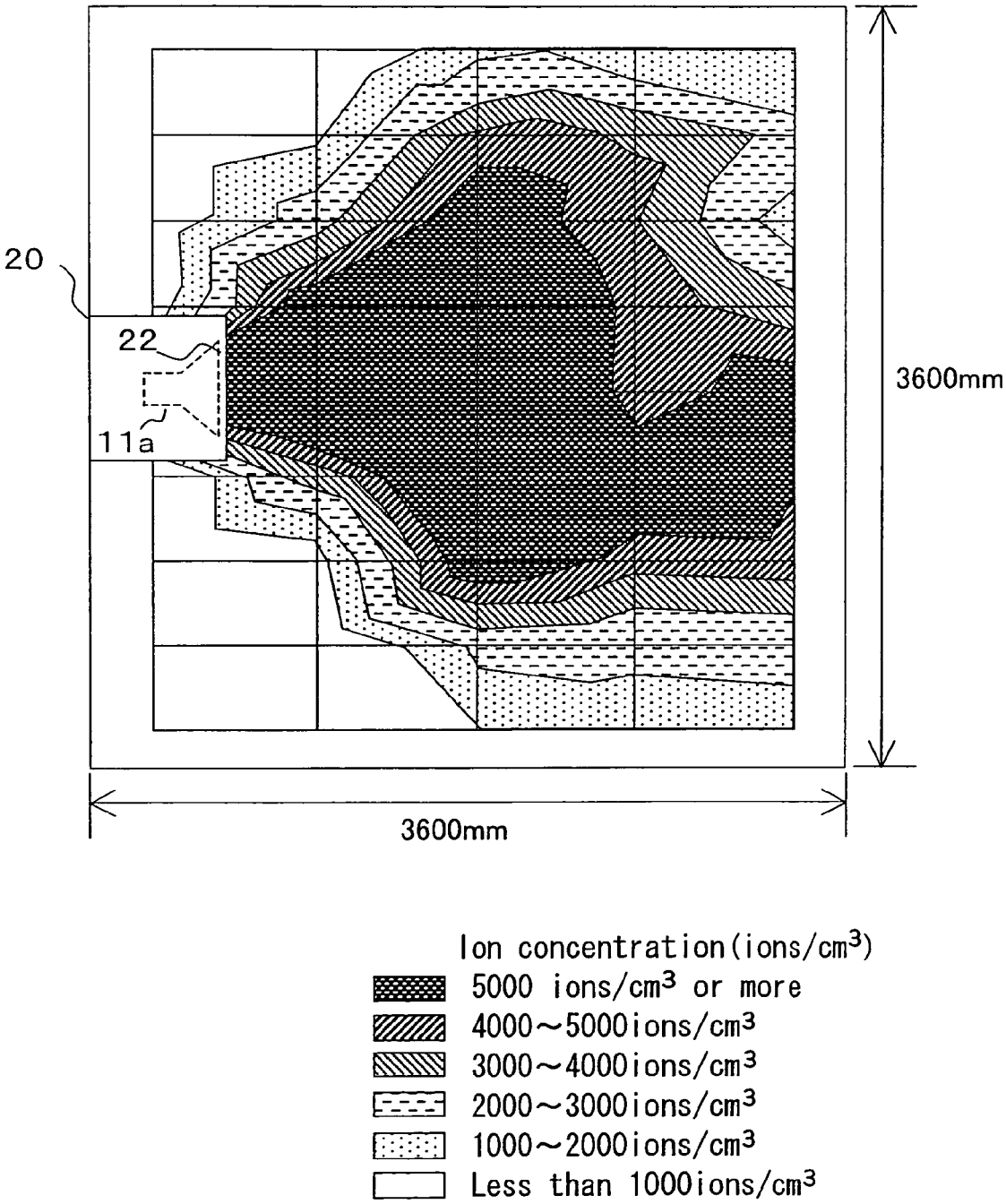
[FIG. 17] An ion concentration distribution at a position in an eight-mat room at a height of 1700 mm from the mat when the ion diffusing apparatus according to the sixth embodiment of the invention of the refrigerator is operated.
Figure 18:
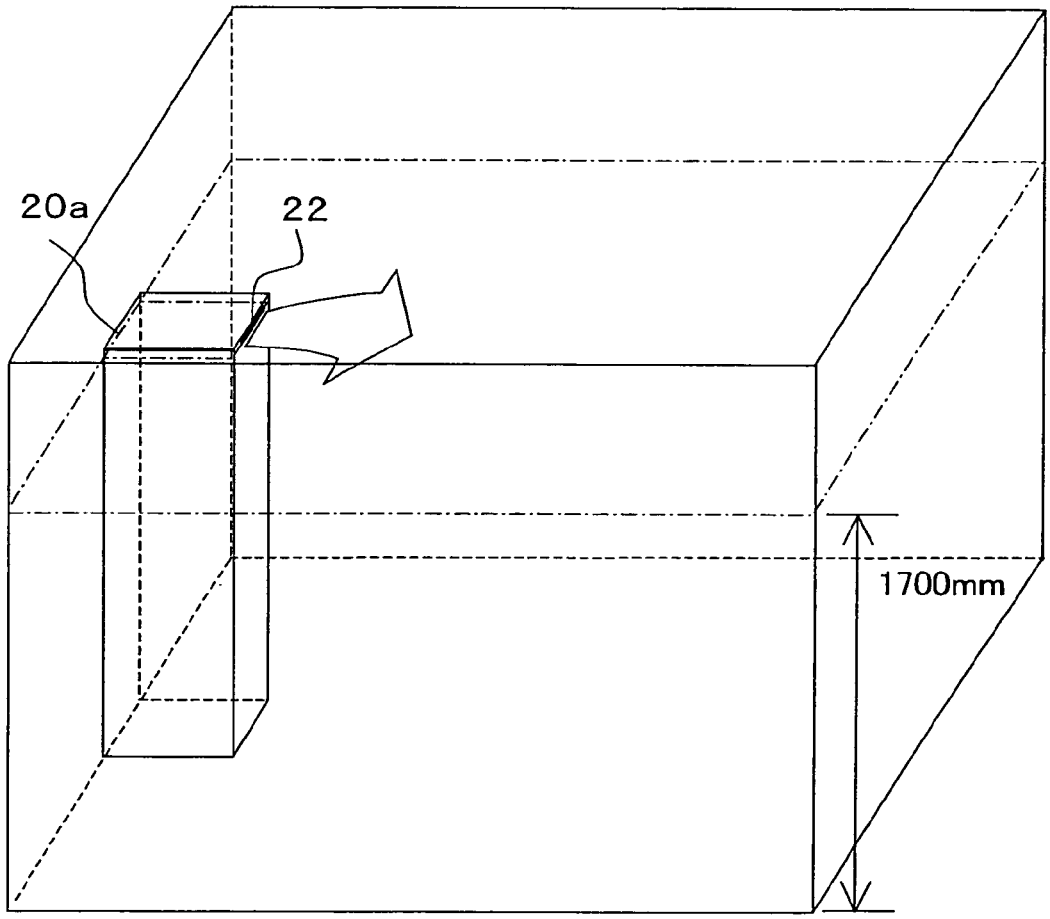
[FIG. 18] A positional relation between the refrigerator having the ion diffusing apparatus according to the sixth embodiment of the invention and a measuring point of the ion concentration distribution in the room.

FIG. 17 shows a concentration of so-called cluster ions which are discharged from the outer-side ion blowout opening 22 of the refrigerator 20 having the ion diffusing apparatus 11*a* of this embodiment and which become $H^+(H_2O)_n$ and $O_2^-(H_2O)_m$ as measured at various positions in a room at 15° C. in temperature. FIG. 18 shows a positional relation between the refrigerator of the embodiment and a measuring point of the ion concentration distribution in the room. The room is an eight-mat room (2400 mm in height, 3600 mm in width and 3600 mm in length). The measuring point is a cross section having 1700 mm in height from the floor surface of the room as shown with chain lines in FIG. 18. The wind velocity of the outer-side ion blowout opening 22 at that time is substantially uniform and is 1.5 m/s in any position in the longitudinal direction of the blowout opening. The arrow in FIG. 18 shows a state of the air current at that time. A noise value at 1 m forward position of the refrigerator at that time is 22 dB.

When the plus ions concentration is 2000 ions/$cm^3$ or more and the minus ions concentration is 2000 ions/$cm^3$ or more, the sterilizing effect is confirmed.

It is apparent from comparison with an ion diffusing apparatus 110*a* of a later-described comparative example 2 that ions discharged from the outer-side ion blowout opening 22 reach the ends of the room as shown in FIG. 17. The ion concentration at 10 mm forward position of the outer-side ion blowout opening 22 of this embodiment is about 10000 ions/$cm^3$, and ions of high concentration do not stagnate in the vicinity of the blowout opening unlike the comparative example 2. In a region of about 60% or more of the eight-mat room, the plus ions concentration is 2000 ions/$cm^3$ or more and the minus ions concentration is 2000 ions/$cm^3$ or more, and it can be found that the region showing the sterilizing effect is remarkably increased as compared with the comparative example 2.

A mechanism in which the ion dispersing ability of the ion diffusing apparatus 11*a* of the embodiment was remarkably enhanced as compared with the ion diffusing apparatus 110*a* of the comparative example 2 will be explained below. Firstly, the enlarged pipe portion 13*b* is designed to have a function of a diffuser. Therefore, the enlarged pipe portion 13*b* can convert the kinetic energy of the air current into static pressure and thus, the enlarged pipe portion 13*b* can assist the wind blowing ability of the blower 12. For this reason, the wind blowing amount is increased and the blower noise is reduced as compared with a case in which all of pressure loss generated in the air filter (not shown), the narrow portion 13*a* and other wind-blowing paths 13 are applied to the blower 12. Therefore, since the ions are transferred by a large amount of air current as compared with the comparative example 2, the dispersing efficiency is largely enhanced. The wind amount of the ion diffusing apparatus 11*a* is about twice as large as that of the comparative example 2, and the noise value at 1 m forward position of the refrigerator 29*a* at that time is also 22 dB like the comparative example 2.

Secondly, the narrow portion 13*a* rectifies the disturbance of air flowing in the vicinity of the electrical discharging surface 14*a* of the ion generating apparatus 14, and suppresses the deviation of flow, i.e., so-called drift generated at the downstream portion of the blower 12. Thus, the disturbance of the air current is largely suppressed as compared with the comparative example 2. When ions collide against the wall surface or other obstacle, the ions lose the electric charge. When the ion generating apparatus 14 generates substantially the same amounts of plus ions and minus ions, the plus ions and minus ions collide against each other and the ions disappear. That is, if the air current is disturbed, the amount of ions to be disappeared is increased by the collision between the obstacle and ions and/or between the ions. If the air current is rectified, the amount of ions to be disappeared caused by the collision between the obstacle and ions and/or between the ions is reduced and thus, the lifetime of ion is elongated. The ion concentration is attenuated to 1/e within about three seconds in the comparative example 2, but in this embodiment, about five seconds are required until the ion concentration is attenuated to 1/e.

Thirdly, since the disturbance or deviation of air flowing in the vicinity of the electrical discharging surface 14*a* of the ion generating apparatus 14 is suppressed, the air flowing in the vicinity of the electrical discharging surface 14*a* of the ion generating apparatus 14 becomes uniform. With this, the ion generating efficiency on the electrical discharging surface 14*a* of the ion generating apparatus 14 is increased. That is, a desired amount of ions can be generated with lower voltage or a smaller wind amount, and the noise is reduced.

Fourthly, the positional relation between the wind-blowing path 13 and the ion generating apparatus 14 is set such that the width of the electrical discharging surface 14*a* of the ion generating apparatus 14 in the direction perpendicular to the flow and the width of the wind-blowing path 13 facing the electrical discharging surface 14*a* are equal to each other. With this, the variation of the ion concentration in the direction perpendicular to the flow is suppressed, the ion concentration in the wind-blowing path 13 of the downstream portion of the ion generating apparatus 14 becomes substantially uniform in a plane perpendicular to the flowing direction, and the ions can efficiently be brought into the air current. Thus, the ions can efficiently be transferred and dispersed.

Fifthly, the attenuation of wind velocity is suppressed by optimizing the aspect ratio of the blowout opening and by elongating the potential core of jet stream. Thus, the spray travel distance of air current is remarkably elongated as compared with the comparative example 2. The explanation of the potential core, the mechanism which elongates the spray travel distance of air current caused by elongation of the potential core, and the effect of the mechanism are the same as those of the first embodiment. Thus, the blowout opening area and the blowout opening wind velocity are the same, i.e., if the wind amounts are the same, the potential core length, i.e., the spray travel distance of air current can be elongated by optimizing the aspect ratio of the blowout opening. In other words, if the potential core lengths, i.e., the spray travel distances of air current are the same, since the wind amount can be reduced, the electricity consumption and the noise value of the blower 12 can be reduced.

Seventh Embodiment

Figure 19:
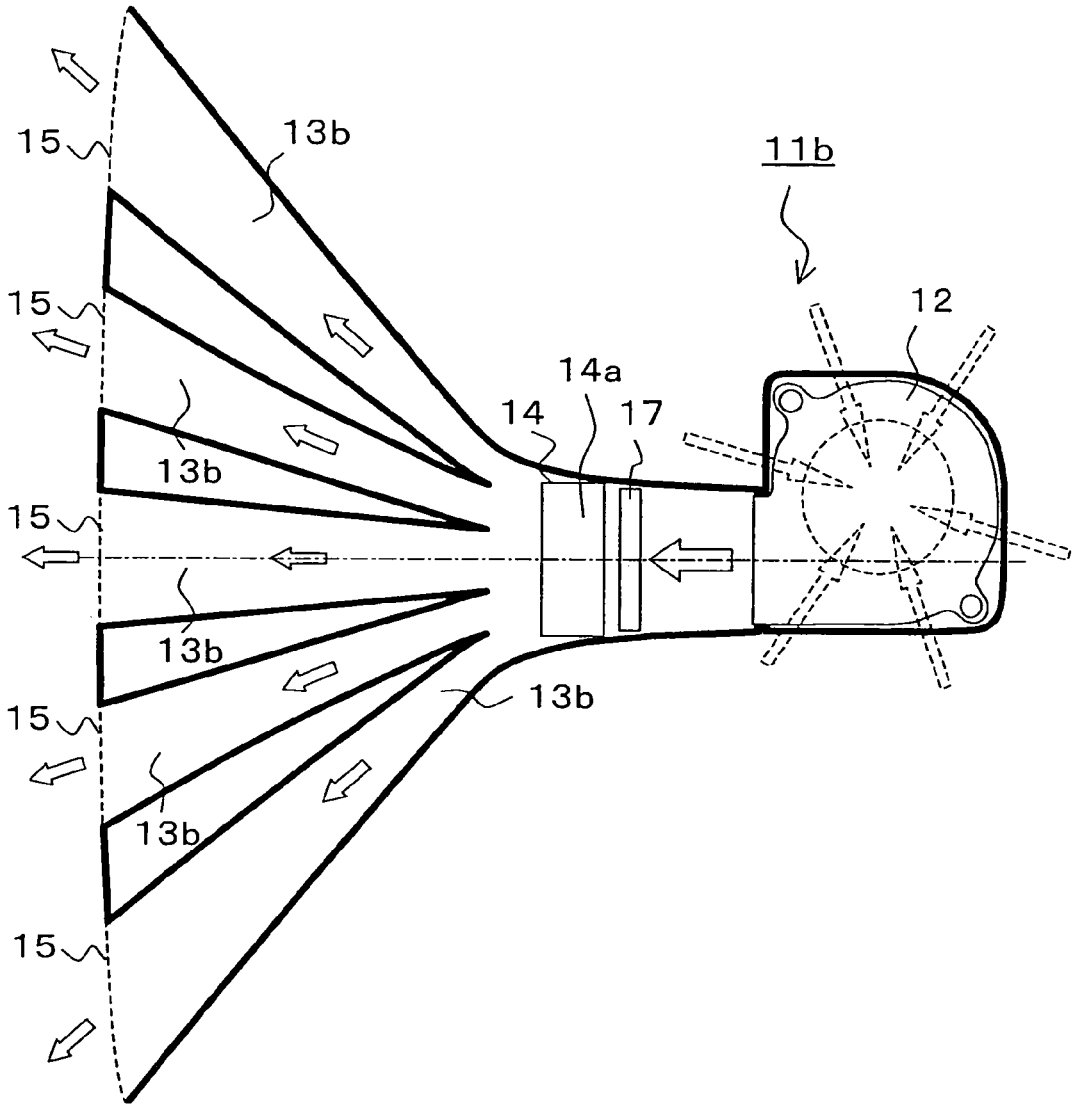
[FIG. 19] A schematic sectional plan view showing an ion diffusing apparatus according to a seventh embodiment of the invention.
Figure 20:
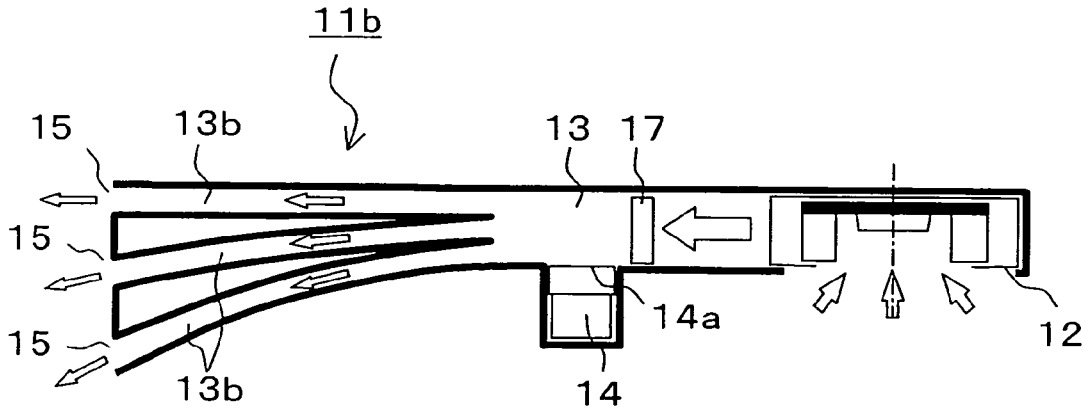
[FIG. 20] A schematic sectional side view showing the ion diffusing apparatus according to the seventh embodiment of the invention.

A seventh embodiment will be explained next. FIG. 19 is a schematic sectional plan view showing an ion diffusing apparatus according to the seventh embodiment, and FIG. 20 is a schematic sectional side view showing the ion diffusing apparatus according to the embodiment.

In the seventh embodiment, the narrow portion 13*a* of the sixth embodiment is omitted, and a rectifier 17 is provided in the wind-blowing path 13 upstream of the electrical discharging surface 14*a* of the ion generating apparatus 14. With this structure, the disturbance of air flowing in the vicinity of the electrical discharging surface 14*a* of the ion generating apparatus 14 can be rectified. Therefore, the effect of the narrow portion 13*a* in the sixth embodiment can be obtained, the pressure loss generated in the narrow portion 13*a* of the sixth embodiment can be eliminated, and the pressure loss generated in the wind-blowing path 13 can be reduced. Thus, the wind amount of the blower 12 can be increased and/or the noise of the blower 12 can be reduced. The wind introducing plate 16 of the enlarged pipe portion 13*b* is omitted, and the wind-blowing path 13 is divided into a plurality of enlarged pipe portions 13*b* from the downstream portion immediately after the ion generating apparatus 14. In this embodiment, the wind-blowing path 13 is divided into five enlarged pipe portions 13*b* in the lateral direction and three enlarged pipe portions 13*b* in the vertical direction, i.e., the fluid flowing passage 3 is divided into total fifteen enlarged pipe portions 13*b* and thus, fifteen diffusing apparatus blowout openings 15 are provided. The divided wind-blowing paths 3 and their enlarged pipe portions 13*b* are designed such that the aspect ratios are increased as they approach the blowout opening 5, and the aspect ratio thereof at the position of the blowout opening 5 is set to about 8.

Other structures are the same as those of the other embodiment of the sixth embodiment. Like the sixth embodiment, the wind-blowing path 13 and the diffusing apparatus blowout opening 15 are in communication with the outer-side ion blowout opening 22 provided in the upper portion of the door 21 disposed on the front surface of the refrigerator 20*a* so that ions are discharged and dispersed outside the refrigerator.

In the seventh embodiment, the distribution of ions is different from that of the sixth embodiment. That is, the wind amount is increased due to the reduction in pressure loss of the wind-blowing path 13. Thus, the forward dispersing distance of ions of the refrigerator is slightly increased, the ion concentration in the vertical direction in the forward space of the refrigerator becomes more uniform, and the ion concentration at a front and lower portion of the refrigerator can be increased.

The shapes of the diffusing apparatus blowout opening 15 and the outer-side ion blowout opening 22 are not limited to the relation of height<width.

Eighth Embodiment

Figure 21:
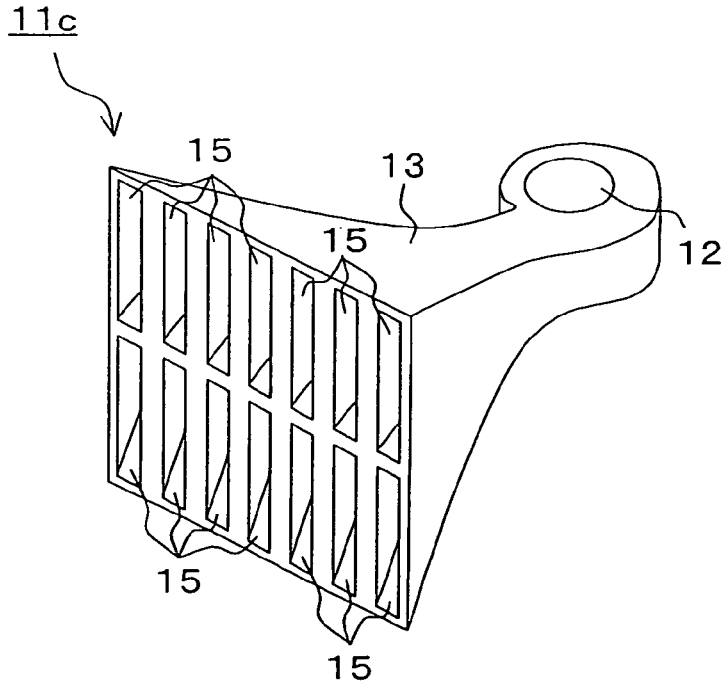
[FIG. 21] A perspective view showing an ion diffusing apparatus according to an eighth embodiment of the invention.

An eighth embodiment will be explained next. FIG. 21 is a perspective view showing an ion diffusing apparatus according to the eighth embodiment.

In the eighth embodiment, the wind-blowing path 13 and the diffusing apparatus blowout opening 15 of the seventh embodiment are formed in the same manner as the fluid flowing passage 3 and the blowout opening 5 of the fluid generating apparatus 1*d* of the third embodiment. Therefore, the shape of the diffusing apparatus blowout opening 15 has the relation of height>width, and the wind-blowing path 13 is divided into seven enlarged pipe portions 13*b* in the lateral direction and two enlarged pipe portions 13*b* in the vertical direction, i.e., the wind-blowing path 13 is divided into total fourteen enlarged pipe portions 13*b* and thus, fourteen diffusing apparatus blowout openings 15 are provided. The divided wind-blowing paths 3 and their enlarged pipe portions 13*b* are designed such that the aspect ratios are increased as they approach the blowout opening 5, and the aspect ratio thereof at the position of the blowout opening 5 (in this case, height of the blowout opening/width of the blowout opening) is set to about 8.

Other structures are the same as those of the other embodiment of the seventh embodiment. Like the seventh embodiment, the wind-blowing path 13 and the diffusing apparatus blowout opening 15 are in communication with the outer-side ion blowout opening 22 provided in the upper portion of the door 21 disposed on the front surface of the refrigerator 20 so that ions are discharged and dispersed outside the refrigerator.

The distribution of ions of the seventh embodiment is different from that of the sixth embodiment. That is, the dispersion distance of ions forward of the refrigerator and the dispersion region of ions in the lateral direction in the forward space of the refrigerator are slightly reduced, but the dispersion region of ions in the vertical direction in the forward space of the refrigerator is remarkably increased, the ion concentration in the vertical direction becomes more uniform, and the ion concentration of the front and lower portion of the refrigerator can be increased. That is, it is possible to disperse ions to a region which is wide in the vertical direction and the lateral direction forward of the ion diffusing apparatus 11*c*.

Ninth Embodiment

Figure 22:
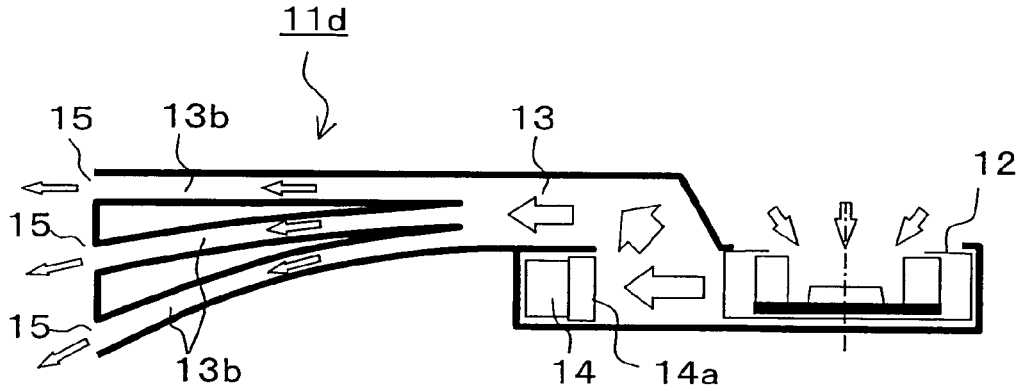
[FIG. 22] A schematic sectional side view showing an ion diffusing apparatus according to a ninth embodiment of the invention.

A ninth embodiment will be explained next. FIG. 22 is a schematic sectional side view showing an ion diffusing apparatus according to the ninth embodiment.

In the ninth embodiment, the rectifier 17 of the seventh embodiment is omitted, the disposition of the ion generating apparatus 14 is different, and the shape of the wind-blowing path 13 in the vicinity of the ion generating apparatus 14 and the air flow are different. The electrical discharging surface 14*a* of the ion generating apparatus 14 is located at a position where the wind flow sent out from the blower 12 is hindered. Air sent out from the blower 12 collides against the electrical discharging surface 14*a* of the ion generating apparatus 14, the air includes ions generated from the electrical discharging surface 14*a*, and flows out toward the wind-blowing path 13 from a side of the ion generating apparatus 14, thereby obtaining the rectifying effect. Other structures are the same as those of the seventh embodiment.

In the ion diffusing apparatus 11*d* of this embodiment, when the air sent out from the blower 12 collides against the electrical discharging surface 14*a* of the ion generating apparatus 14, drift is suppressed. Therefore, although the rectifier 17 is omitted, substantially the same effect as that of the seventh embodiment can be obtained and thus, this embodiment is advantageous in terms of costs.

Tenth Embodiment

Figure 23:
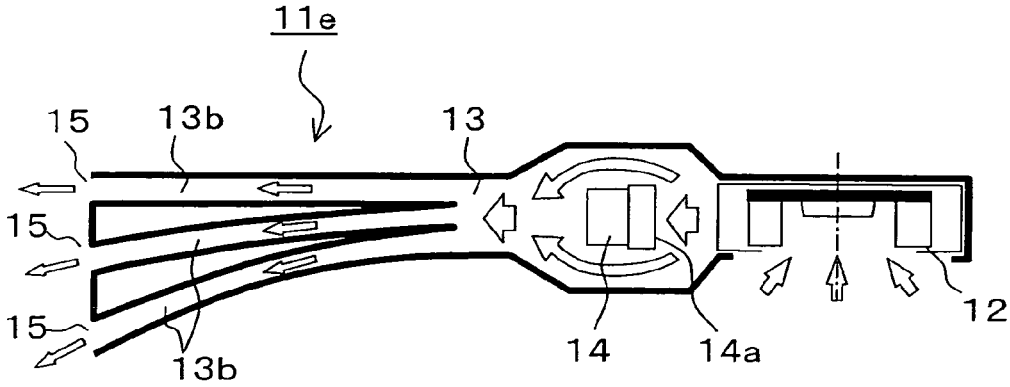
[FIG. 23] A schematic sectional side view showing an ion diffusing apparatus according to a tenth embodiment of the invention.

A tenth embodiment will be explained next. FIG. 23 is a schematic sectional side view showing an ion diffusing apparatus according to the tenth embodiment.

In the tenth embodiment, the rectifier 17 of the seventh embodiment is omitted, the disposition of the ion generating apparatus 14 is different, and the shape of the wind-blowing path 13 in the vicinity of the ion generating apparatus 14 and the air flow are different. The electrical discharging surface 14*a* of the ion generating apparatus 14 is located at a position where the wind flow sent out from the blower 12 is hindered. Air sent out from the blower 12 collides against the electrical discharging surface 14*a* of the ion generating apparatus 14, the air includes ions generated from the electrical discharging surface 14*a*, and flows out toward the wind-blowing path 13 from upper and lower sides of the ion generating apparatus 14, thereby obtaining the rectifying effect. Other structures are the same as those of the seventh embodiment.

In the ion diffusing apparatus 11*e* of this embodiment, when the air sent out from the blower 12 collides against the electrical discharging surface 14*a* of the ion generating apparatus 14, drift is suppressed. Therefore, although the rectifier 17 is omitted, substantially the same effect as that of the seventh embodiment can be obtained and thus, this embodiment is advantageous in terms of costs.

Eleventh Embodiment

Figure 24:
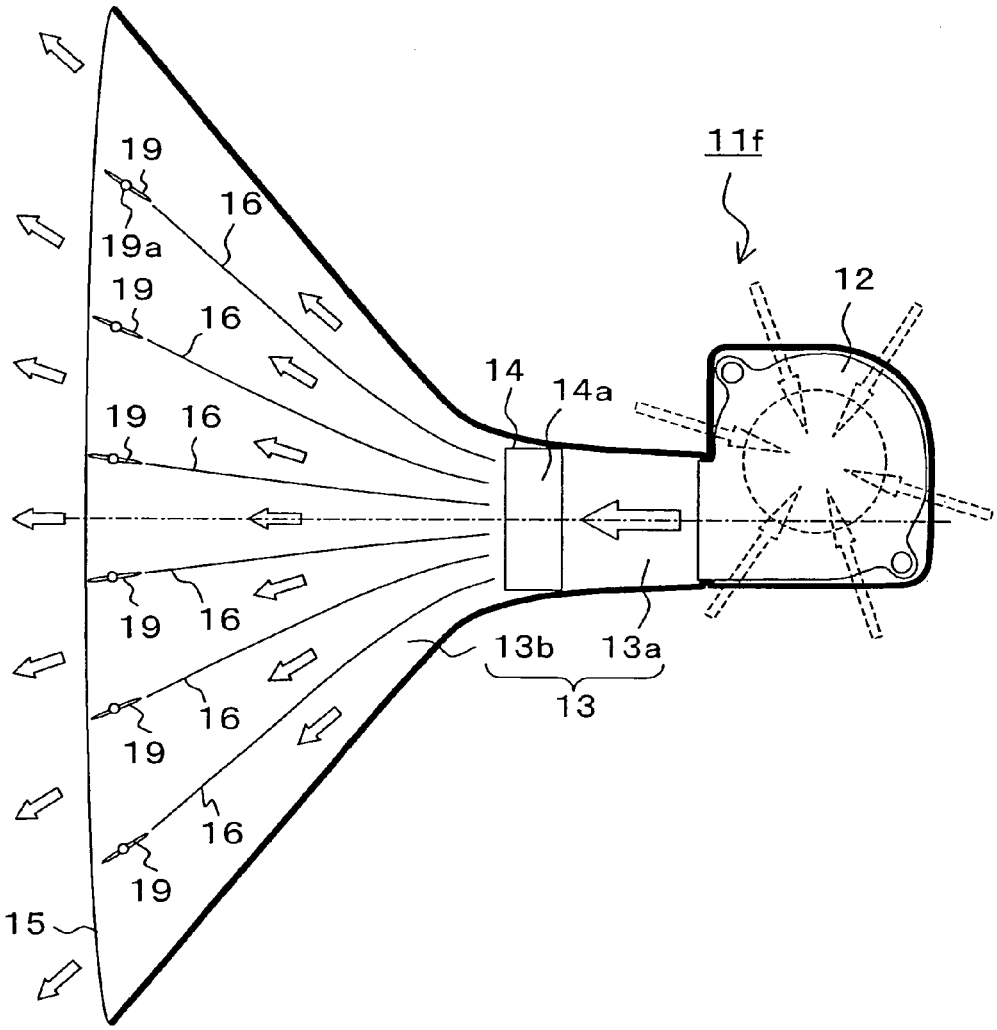
[FIG. 24] A schematic sectional plan view showing an ion diffusing apparatus according to an eleventh embodiment of the invention.

An eleventh embodiment will be explained next. FIG. 24 is a schematic sectional plan view showing an ion diffusing apparatus according to the eleventh embodiment.

In an ion diffusing apparatus 11*f* of the eleventh embodiment, a plurality of wind direction changing plates 19 which rotate in association are added in the vicinity of the diffusing apparatus blowout opening 15 of the sixth embodiment. By changing the direction of the wind direction changing plates 19, the blowout direction of ions can be changed. Other structures are the same as those of the sixth embodiment.

Figure 25:
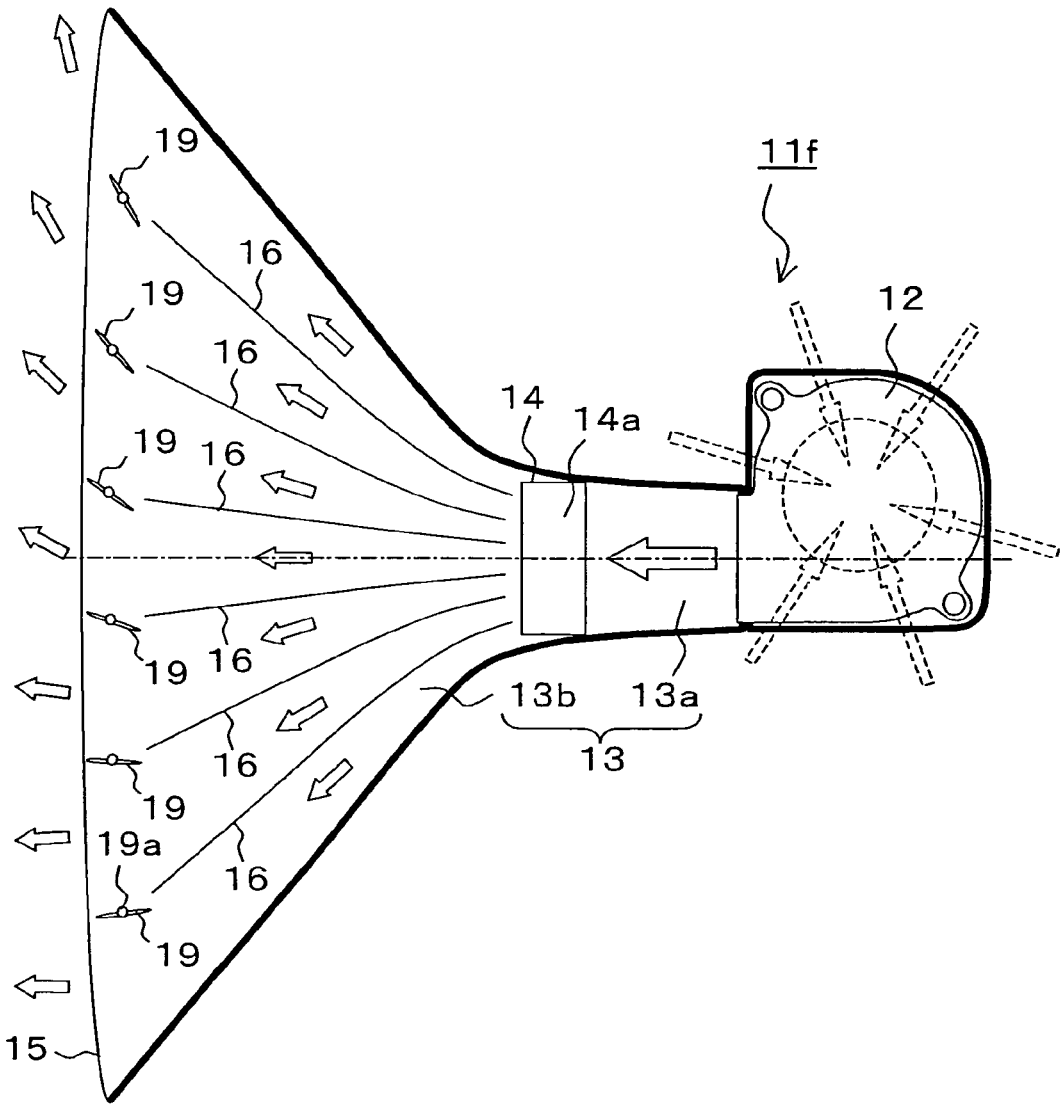
[FIG. 25] A schematic sectional plan view showing the operation of a wind direction changing plate of the ion diffusing apparatus according to the eleventh embodiment of the invention.

In this embodiment, since the directions of the wind direction changing plates 19 can be changed around the rotation shaft 19*a* as shown in FIG. 25 for example, the ions can be intensively dispersed in a desired direction or can be dispersed in a wide range. An apparatus having the ion diffusing apparatus 11*f* can not effectively disperse the jet stream due to its wall surface or obstacles depending upon the installation place of the apparatus in some cases. In the case of the ion diffusing apparatus 11*f* of this embodiment, however, the influence of the wall surface or obstacle can be reduced to some extent by changing the direction of the wind direction changing plates 19.

Twelfth Embodiment

Figure 26:
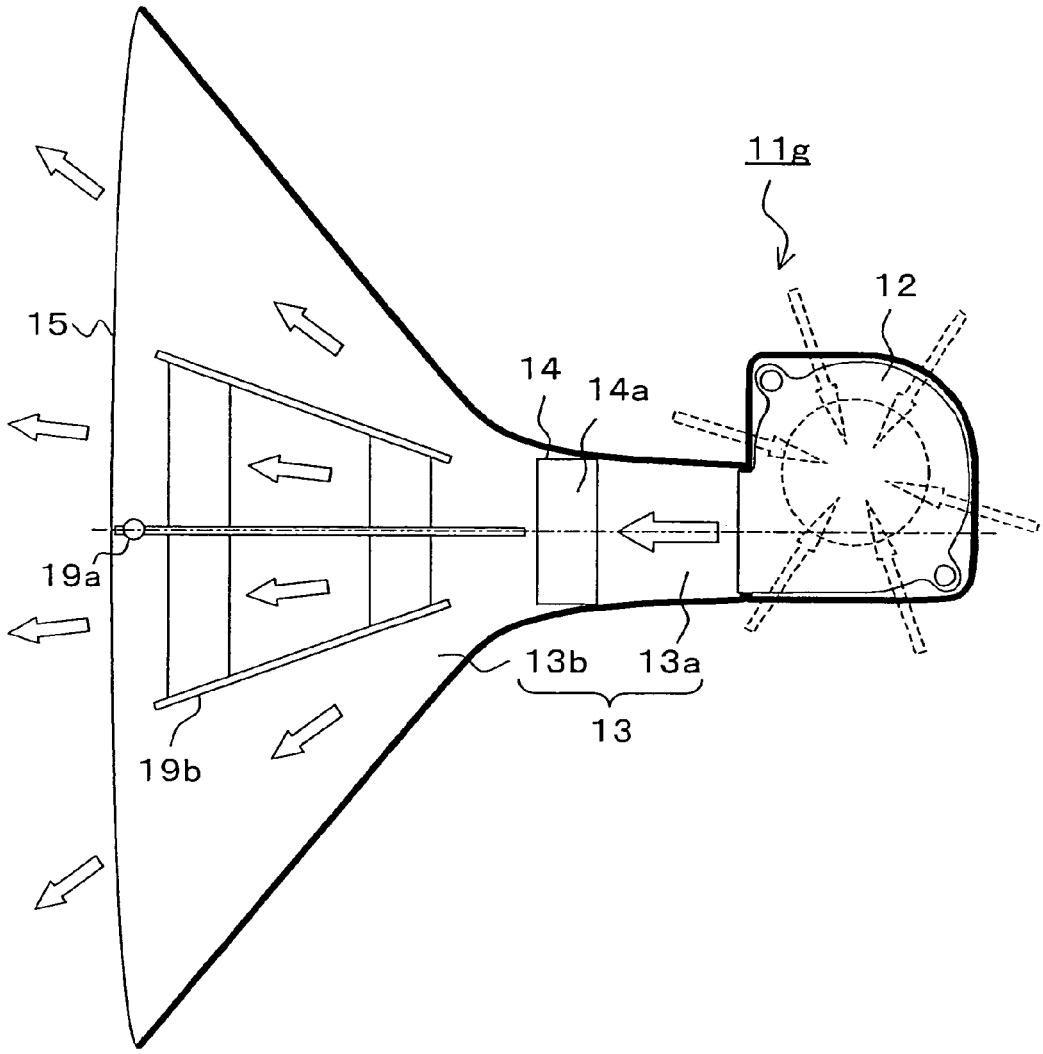
[FIG. 26] A schematic sectional plan view showing an ion diffusing apparatus according to a twelfth embodiment of the invention.

A twelfth embodiment will be explained next. FIG. 26 is a schematic sectional plan view showing an ion diffusing apparatus according to the twelfth embodiment.

In an ion diffusing apparatus 11*g* of this embodiment, the wind introducing plate 16 of the sixth embodiment is omitted, and the wind direction changing unit 19*b* is added to the enlarged pipe portion 13*b*. The wind direction changing plates 19 is integrally molded with three plate members having functions of the wind introducing plates, and the wind direction changing plate 19 can turn around the rotation shaft

19*a*. By changing the direction of the wind direction changing unit 19*b*, the blowout direction of ions can be changed. Other structures are the same as those in the sixth embodiment.

Figure 27:
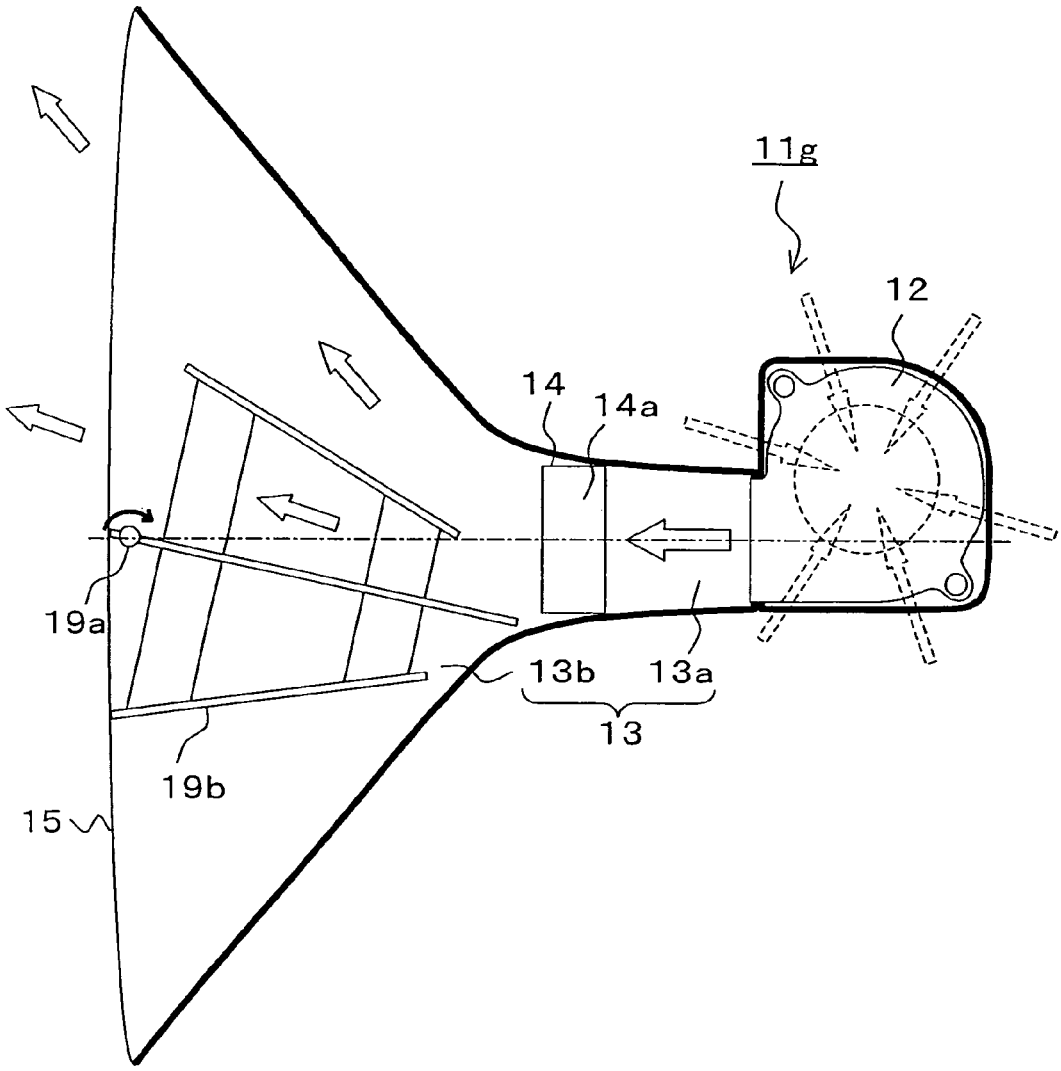
[FIG. 27] A schematic sectional plan view showing the operation of a wind direction changing unit of the ion diffusing apparatus of the twelfth embodiment of the invention.

In this embodiment, by changing the turning angle of the wind direction changing unit 19*b* as shown in FIG. 27 for example, the blowout of ions to the wide range can be switched to only one side blowout. That is, the blowing direction of ions can be switched to three kinds of patterns, i.e., a pattern for blowing ions to a wide range, a pattern for blowing ions to only one side, and a pattern for blowing ions to the other side.

In this embodiment, the number of movable portions is smaller than that of the ion diffusing apparatus 11*f* of the eleventh embodiment and thus, the number of parts can be reduced. Therefore, this embodiment is advantageous in terms of costs and reliability.

Thirteenth Embodiment

Figure 28:
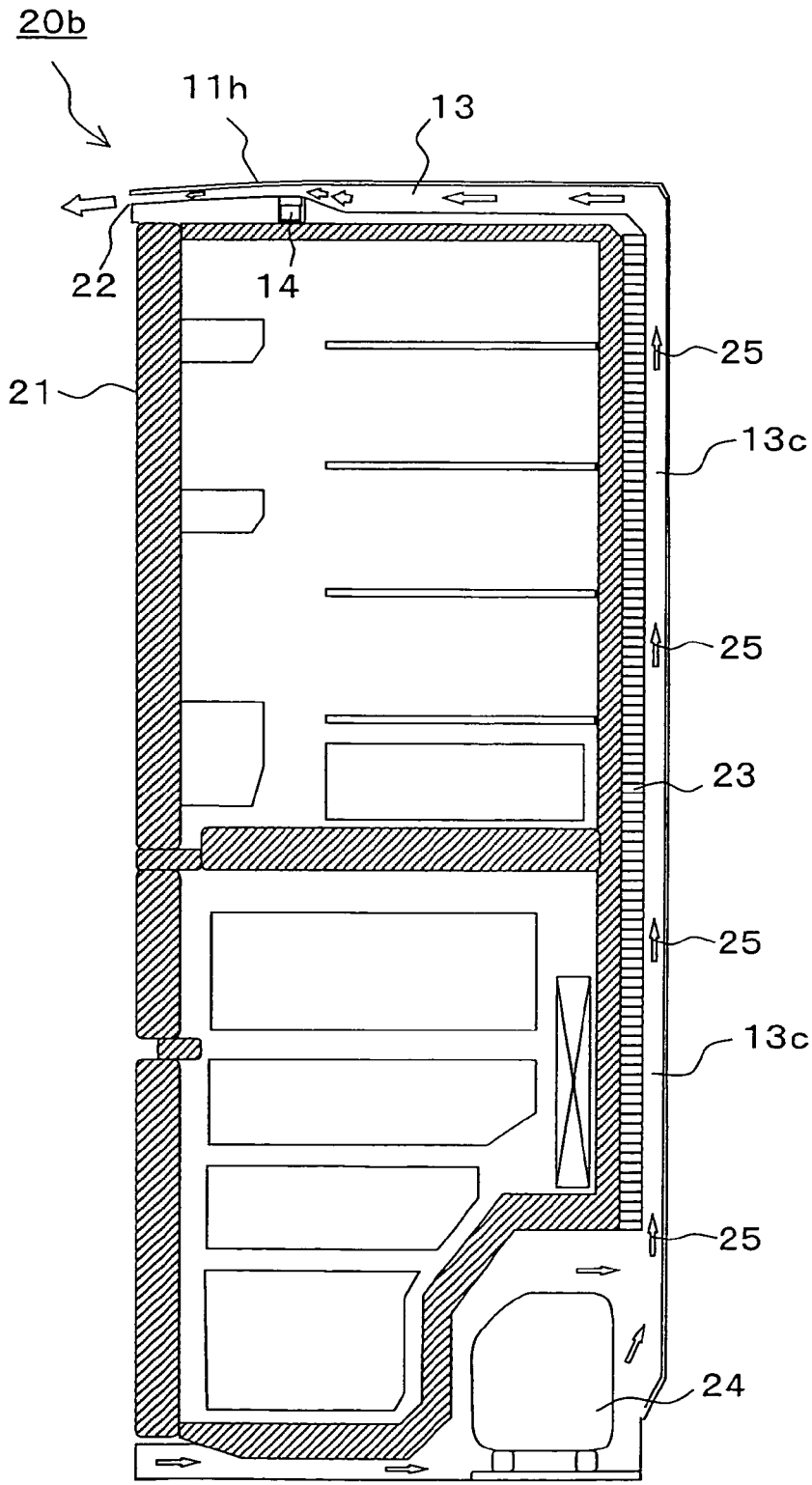
[FIG. 28] A schematic sectional side view of a refrigerator having an ion diffusing apparatus according to a thirteenth embodiment of the invention.

A thirteenth embodiment will be explained next. FIG. 28 is a schematic sectional side view of a refrigerator having an ion diffusing apparatus according to the thirteenth embodiment.

In an ion diffusing apparatus 11*h* of this embodiment, the blower 12 in the sixth embodiment is omitted, an upcurrent flowing passage 13*c* which is a portion of the wind-blowing path 13 is disposed such as to cover a radiating section 23 which is disposed on a back surface and/or side surface of a body of the refrigerator 20*b*. Other structures are the same as those of the sixth embodiment.

If the refrigerator 20*b* of this embodiment is operated, heat is dissipated from a compressor 24 of the refrigerator 20*b* and heat is dissipated from the radiating section 23 which is disposed on the back surface and/or side surface of the body of the refrigerator 20*b* and discharges heat of a heat exchanger (not shown) to outside of the refrigerator. Due to the heat, upcurrent 25 is generated in the upcurrent flowing passage 13*c*, and the air flows upward to the upper portion of the refrigerator 20*b* as shown in FIG. 28. The upcurrent 25 flows through the ceiling of the refrigerator 20*b* along the wind-blowing path 13, and when the upcurrent 25 passes through the ion generating apparatus 14, the upcurrent 25 includes ions, and is discharged and dispersed outside of the refrigerator from the diffusing apparatus blowout opening 15 and the outer-side ion blowout opening 22.

In this embodiment, the blower 12 can be omitted, the blowing noise generated from the blower 12 can be eliminated and thus, the noise can be reduced remarkably. The upward flow of the upcurrent may be assisted by a cycle blower (not shown) which is generally provided in the vicinity of the compressor 24. Even if the ion generating apparatus 14 which generates ion flow is used in the vicinity of the electrical discharging surface 14*a* and ion wind generated by the ion generating apparatus 14 blows air, the same effect as described above can also be obtained.

Fourteenth Embodiment

Figure 29:
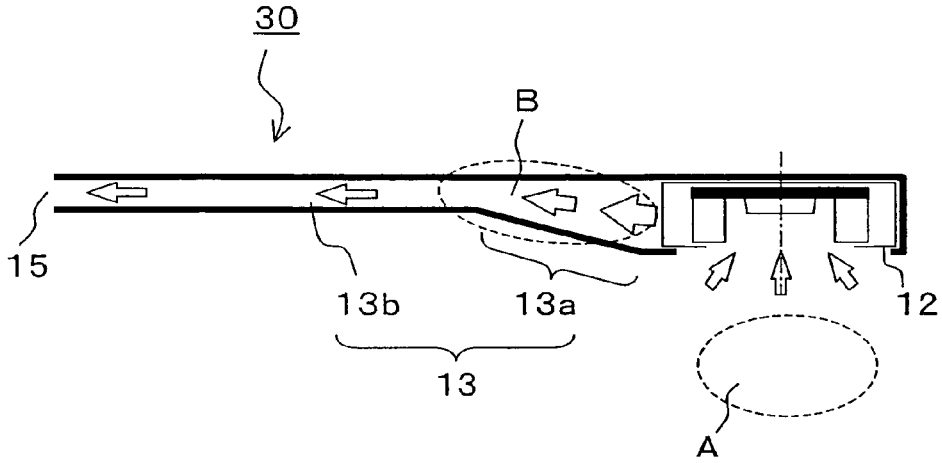
[FIG. 29] A schematic sectional side view showing an essential portion of a microparticle diffusing apparatus according to a fourteenth embodiment of the invention.
Figure 30:
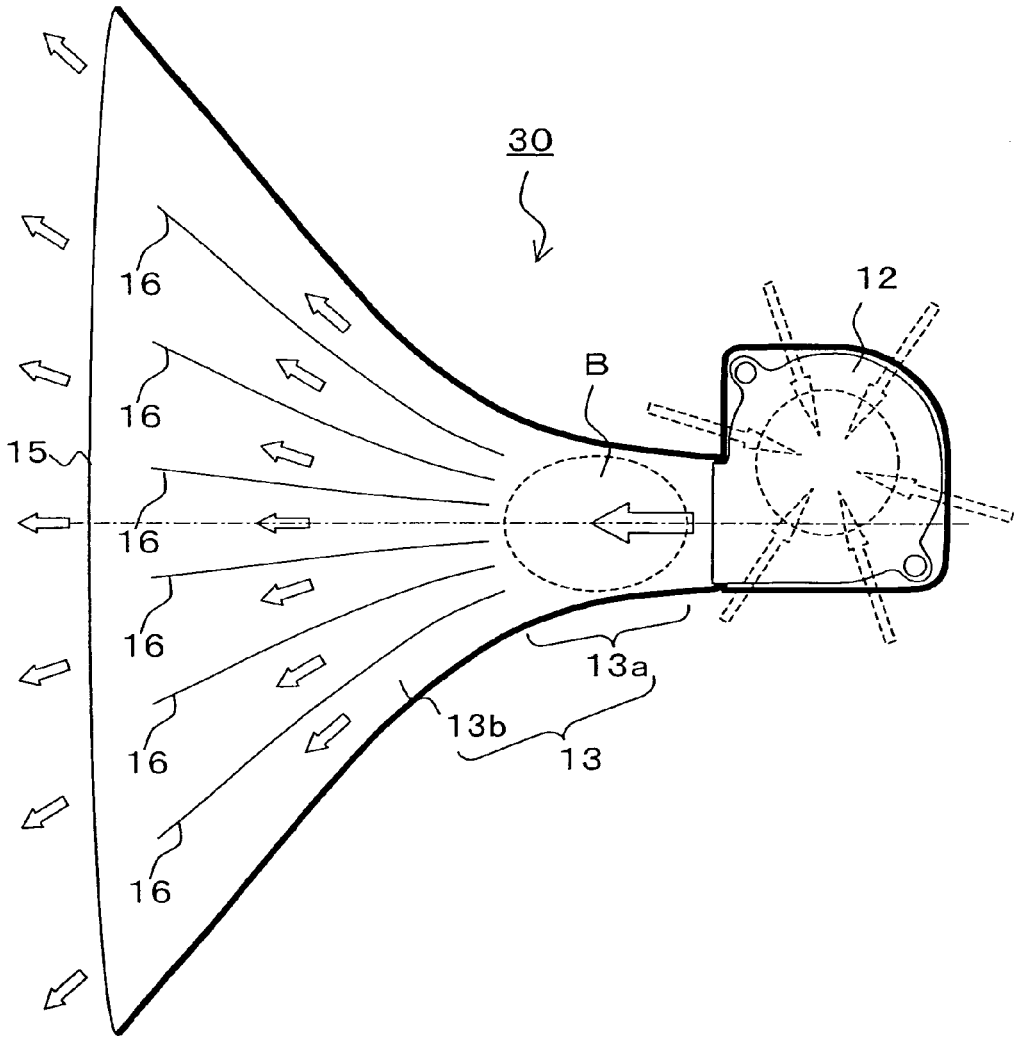
[FIG. 30] A schematic sectional plan view showing the essential portion of a microparticle diffusing apparatus according to the fourteenth embodiment of the invention.

A fourteenth embodiment will be explained next. FIG. 29 is a schematic sectional side view showing an essential portion of a microparticle diffusing apparatus according to the fourteenth embodiment of the invention, and FIG. 30 is a schematic sectional plan view showing the essential portion of a microparticle diffusing apparatus according to the embodiment. An essential portion of the microparticle diffusing apparatus 30 of this embodiment comprises the blower 12, the wind-blowing path 13 and the control section (not shown). Microparticles are transferred by the operation of the blower 12, pass through the wind-blowing path 13, and are discharged outside from the diffusing apparatus blowout opening 15. The wind-blowing path 13 includes the narrow portion 13*a* and the enlarged pipe portion 13*b*.

The height of the wind-blowing path of the narrow portion 13*a* is gradually reduced and the width of the wind-blowing path is gradually increased and the cross-sectional area is gently reduced. The enlarged pipe portion 13*b* extends from the narrow portion 13*a* to the diffusing apparatus blowout opening 15. A cross-sectional area of the enlarged pipe portion 13*b* is smoothly increased toward the diffusing apparatus blowout opening 15. More specifically, at the position of the end point of the narrow portion 13*a*, the height is 12 mm, the width is 30 mm, i.e., the aspect ratio AR is 2.5, at the position of the end point of the narrow portion 13*a*, the height is 8 mm, the width is 40 mm, i.e., the aspect ratio AR is 5, and at the end point of the enlarged pipe portion 13*b*, i.e., at the diffusing apparatus blowout opening 15, the height is 8 mm, the width is 450 mm, i.e., the aspect ratio AR is 56.

The enlarged pipe portion 13*b* is provided with a plurality of wind introducing plates 16 extending from downstream portion of the narrow portion 13*a* toward the upstream portion of the diffusing apparatus blowout opening 15. The interior of the enlarged pipe portion 13*b* is divided into a plurality of pieces by the wind introducing plates 16. In this embodiment, the enlarged pipe portion 13*b* is divided into seven pieces by six wind introducing plates 16. Each of the divided wind-blowing paths 3 has an aspect ratio which is increased toward the diffusing apparatus blowout opening 15, and the aspect ratio at the end of the wind introducing plate 16 closer to the diffusing apparatus blowout opening 15 is set to about 8. The six wind introducing plates 16 are designed such that the wind velocity distribution in the longitudinal direction at the diffusing apparatus blowout opening 15 is substantially the same in any portion thereof. Thus, the ion concentration of the downstream portion of the diffusing apparatus blowout opening 15 becomes substantially uniform in a plane perpendicular to the direction of flow.

In the blower system, a microparticle generating apparatus which generates desired microparticles is disposed. It is preferable that the microparticle generating apparatus is disposed at the position A or B shown in FIGS. 29 and 30. That is, the position A is upstream of the blower 12. When the microparticle generating apparatus is disposed on this position, microparticles are uniformly mixed with air by the mixing ability of the blower 12. The position B is at the narrow portion 13*a* or immediately downstream of the narrow portion 13*a*. If the microparticle generating apparatus is disposed on this position, microparticles are relatively uniformly mixed with air by the rectifying effect of the narrow portion 13*a*.

Examples of the microparticles are particles having electric charge such as plus ions, minus ions and cluster; various active molecules such as radical, atoms, oxygen molecules, water molecules (water vapor); microparticle, aromatic component and medicinal having a sterilizing function; air from which pollen, dust and the like are removed by an air cleaner, and microparticles which are dispersed in the air to exhibit a function.

According to this embodiment, like the sixth embodiment, it is possible to disperse the microparticles to a wide range. A rectifier or a rectifying section may be provided instead of the narrow portion 13*a*. Even if the wind-blowing path 13 is divided and the aspect ratio of the terminal end of the wind-blowing path 13, i.e., the diffusing apparatus blowout openings 15 is set to about 8 instead of using the wind introducing plate 16, the same effect can be obtained.

Figure 31:
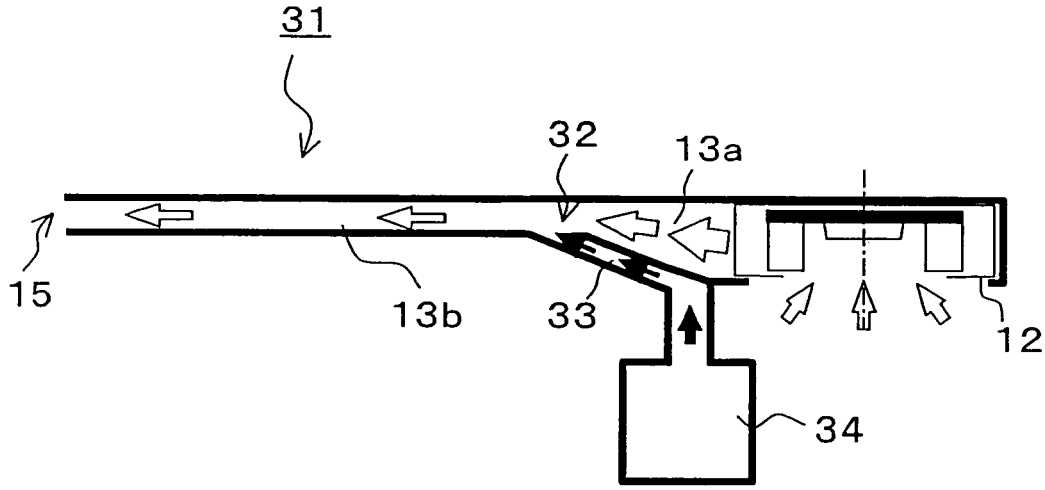
[FIG. 31] A schematic sectional side view showing a water vapor diffusing apparatus according to another embodiment of the fourteenth embodiment of the invention.

Another embodiment of the fourteenth embodiment will be explained next. FIG. 31 is a schematic sectional side view showing a water vapor diffusing apparatus mounted on a humidifier as one example of the microparticle diffusing apparatus of this embodiment. In the water vapor diffusing apparatus 31 of this embodiment, a water vapor blowout opening 32 is provided at the position B shown in FIGS. 29 and 30 in addition to the microparticle diffusing apparatus 30. The water vapor diffusing apparatus 31 includes a water vapor flowing passage 33 which is in communication with the water vapor blowout opening 32 and a water vapor generating apparatus 34. The water vapor generating apparatus 34 comprises a water tank (not shown), and a heater which heats water in the water tank and generates water vapor. According to this embodiment, it is possible to disperse the water vapor to a wide range like the fourteenth embodiment.

In the refrigerator of this invention, the outer-side ion blowout opening 22 may be provided on a ceiling of the refrigerator. According to this structure, it is possible to disperse the microparticles having the sterilizing function to further location, and a space where microparticles such as suspended bacteria existing in a space around the refrigerator can be increased. Therefore, suspended bacteria are prevented from coming into the refrigerator from outside when its door is opened and closed, and sanitary inside environment is realized.

Although the embodiments have been explained above, the present invention is not limited to these embodiments, and the invention may be modified within a range not departing from the subject matter of the invention. Even if the ion diffusing apparatus and the microparticle diffusing apparatus are applied to other devices other than the refrigerator, the same effect can be obtained.

COMPARATIVE EXAMPLE 1

Figure 32:
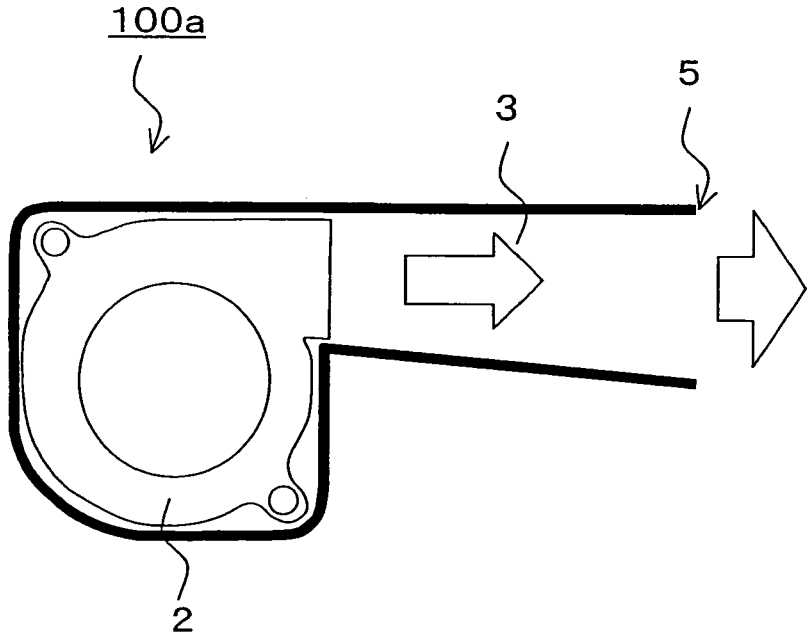
[FIG. 32] A schematic sectional plan view showing a fluid generating apparatus of a comparative example 1.
Figure 33:
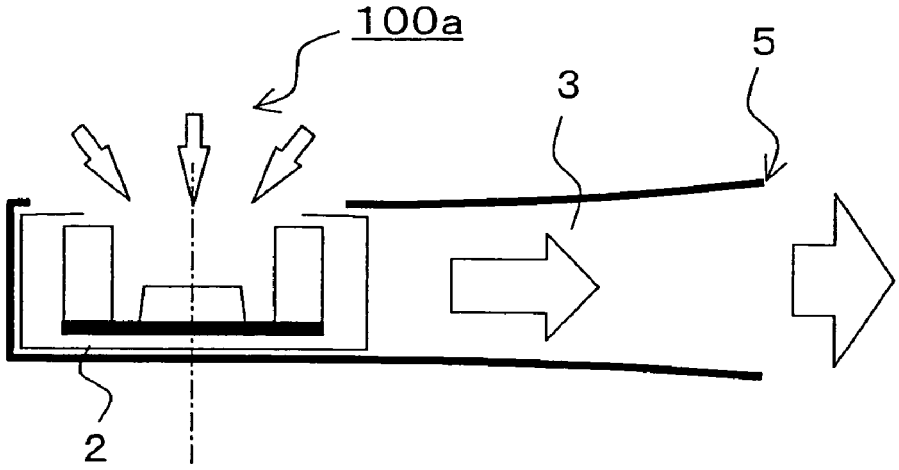
[FIG. 33] A schematic sectional side view showing the fluid generating apparatus of the comparative example 1.

A comparative example to be compared with the first embodiment will be explained. FIG. 32 is a schematic sectional plan view showing a fluid generating apparatus of a comparative example 1, and FIG. 33 is a schematic sectional side view showing the fluid generating apparatus of the comparative example 1. The fluid generating apparatus 100*a* of the comparative example 1 comprises the fluid sending apparatus 2, the fluid flowing passage 3, the blowout opening 5 for generating a jet stream, and a control section (not shown). Fluid is transferred by the operation of the fluid sending apparatus 2, passes through the fluid flowing passage 3, and is discharged outside of the blowout opening 5 as the jet stream. Arrows in the drawings show a flow of the fluid.

Figure 34:
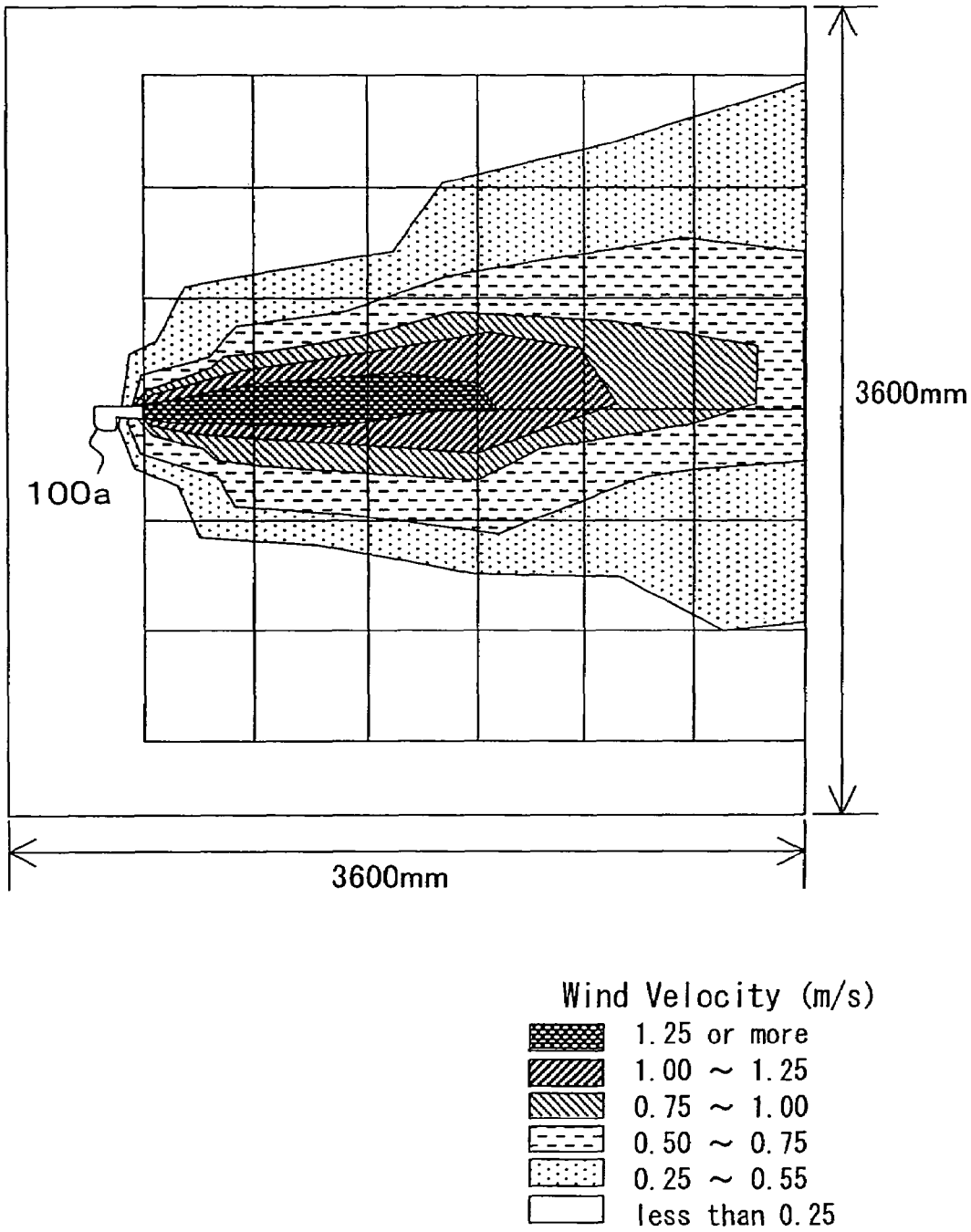
[FIG. 34] A flow rate distribution when the fluid generating apparatus of the comparative example 1 is operated.

FIG. 34 shows a flow rate distribution when air having blowing flow rate of 1.5 m/s is sent out from a blowout opening having a height of 60 mm and a width of 60 mm as a using example of the fluid generating apparatus 100*a*. In the drawings, one block in the lattice has 0.5 m. Even if the fluid sent from the blowout opening is liquid, substantially the same tendency is qualitatively seen. It is found from FIG. 34 that the fluid generating apparatus 100*a* of the comparative example 1 has a problem that the spray travel distance of jet stream is short.

It is also found that the fluid generating apparatus 100*a* of the comparative example 1 has a problem that it is not suitable for transferring fluid to a wide range. Generally, the shape of the blowout opening of the fluid generating apparatus using the conventional technique has a low aspect ratio in many cases. A jet stream sent out from such a blowout opening is less prone to spread widely, and even if the jet stream spreads widely, the flow rate is largely reduced.

COMPARATIVE EXAMPLE 2

Figure 35:
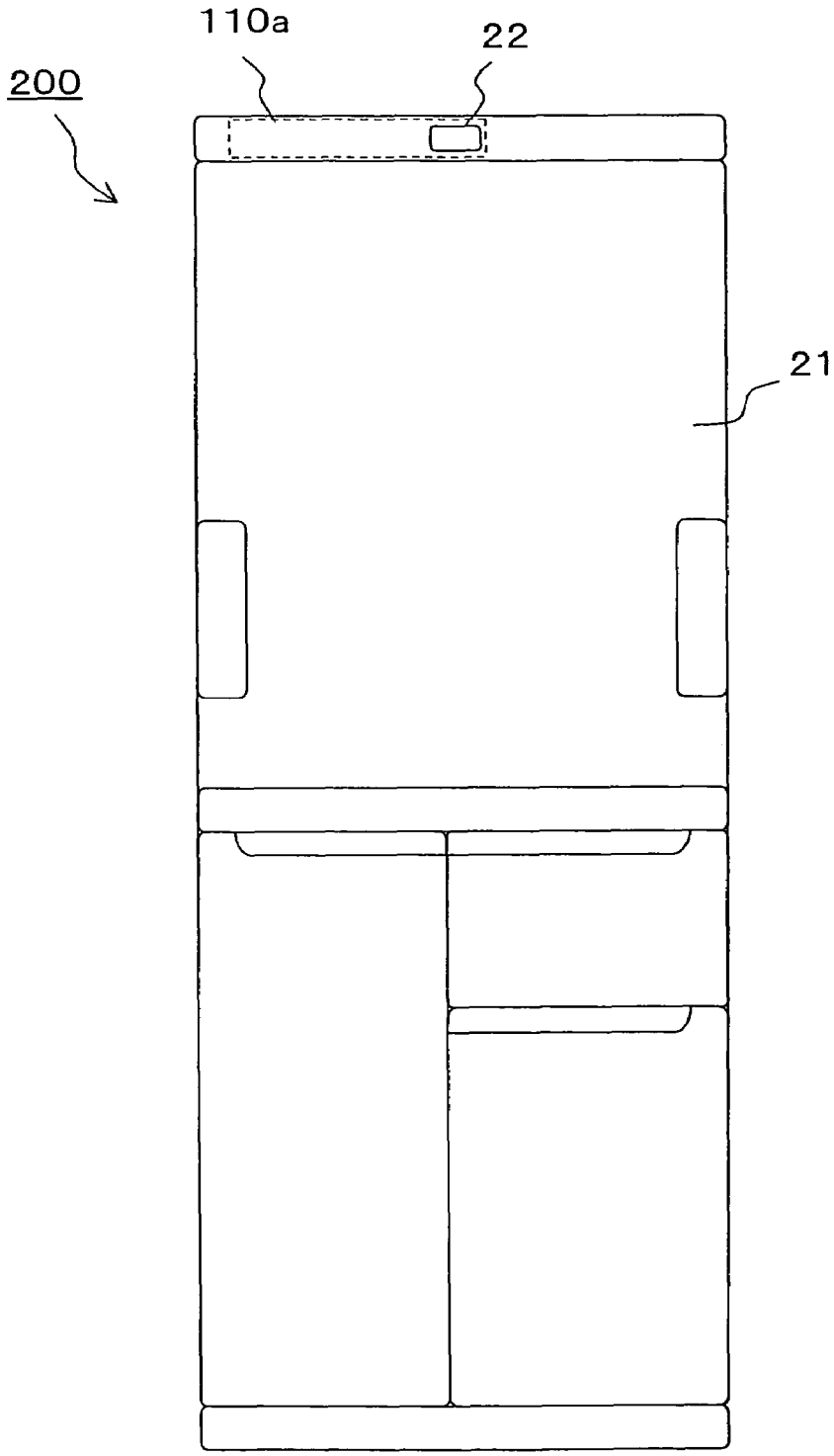
[FIG. 35] A front view of a refrigerator having an ion diffusing apparatus of a comparative example 2.
Figure 36:
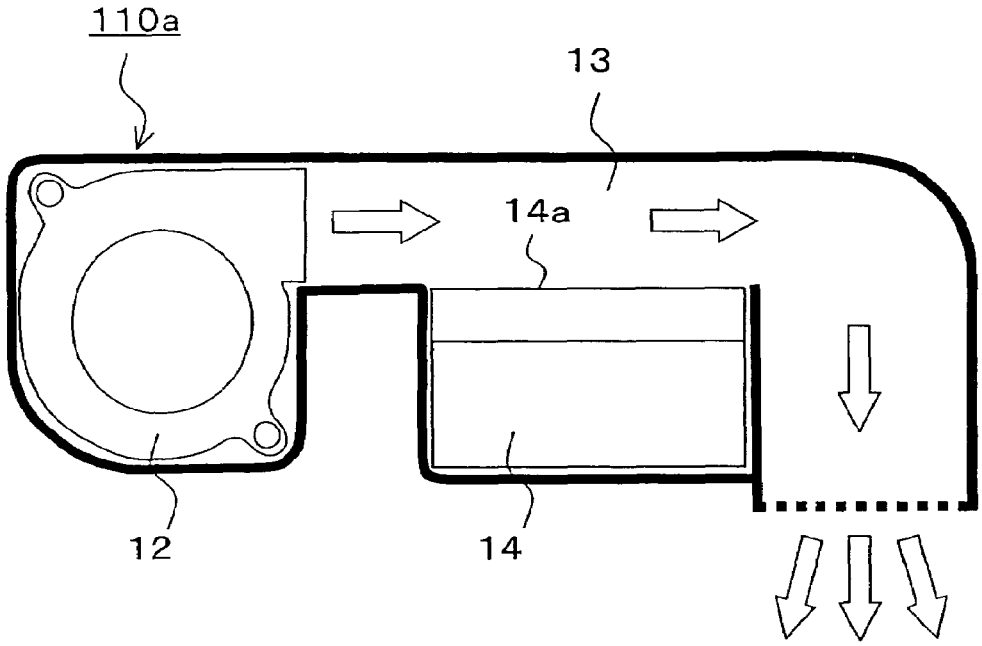
[FIG. 36] A schematic sectional plan view showing the ion diffusing apparatus of the comparative example 2.

A comparative example 2 to be compared with the sixth embodiment will be explained. FIG. 35 is a front view of a refrigerator having an ion diffusing apparatus of the comparative example 2, and FIG. 36 is a schematic sectional plan view showing the ion diffusing apparatus of the comparative example 2. As shown in FIG. 35, a ceiling of the refrigerator 200 of the comparative example 2 is provided with an ion diffusing apparatus 110*a* of the comparative example 2.

The ion diffusing apparatus 110*a* of the comparative example 2 comprises the blower 12, the wind-blowing path 13, the ion generating apparatus 14 having the electrical discharging surface 14*a* which faces the wind-blowing path 13, and the control section (not shown). Ions generated by the operation of the ion generating apparatus 14 is transferred by the operation of the blower 12, passes through the wind-blowing path 13, and is discharged out from the diffusing apparatus blowout opening 15. Arrows in FIG. 36 show a state of air current at that time. An upper portion of the door 21 of the refrigerator 200 is provided with the outer-side ion blowout opening 22 with which the wind-blowing path 13 and the diffusing apparatus blowout opening 15 are in communication so that the ions are discharged and dispersed outside of the refrigerator. An air filter (not shown) is provided at upstream of the suction opening of the blower 12 of the ion diffusing apparatus 100*a* for preventing greasy fumes and dust from entering into the ion diffusing apparatus 110*a*.

The ion generating apparatus 14 can generate ions which become $H^+(H_2O)_n$ and $O_2^-(H_2O)_m$. Ions generated from the electrical discharging surface 14*a* of the ion generating apparatus 14 are discharged into the wind-blowing path 13, and sent outside of the refrigerator from the diffusing apparatus blowout opening 15 and the outer-side ion blowout opening 22 by the operation of the blower 12.

By discharging the plus ions and minus ions into a living space outside the refrigerator around the forward area of the refrigerator 200, suspended bacteria existing in the living space are sterilized, and sanitary living space can be provided, and it is possible to prevent the suspended bacteria from entering into the refrigerator from the outside when the door 21 is opened or closed, and sanitary inside environment of the refrigerator can be obtained.

Figure 37:
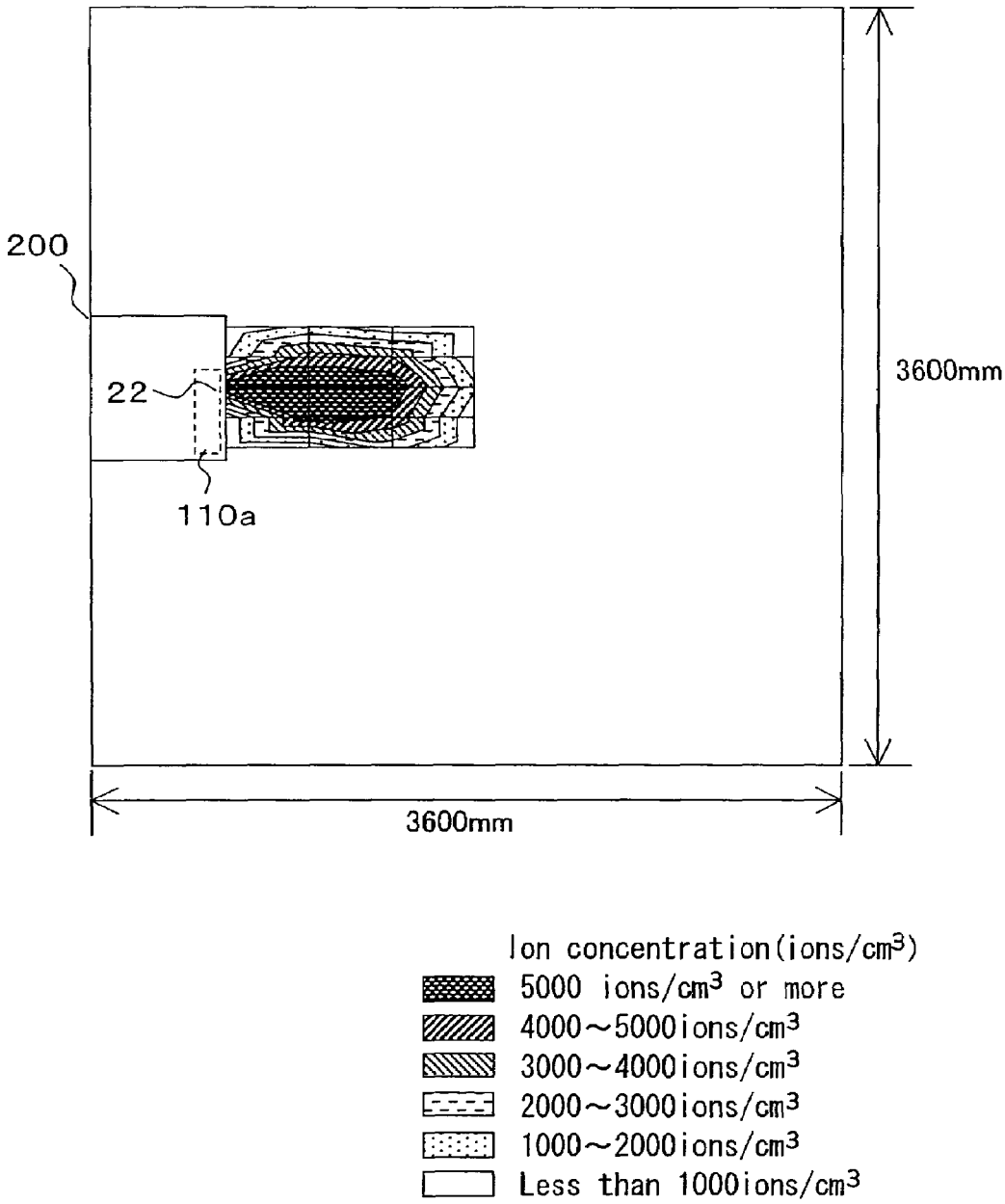
[FIG. 37] An ion concentration distribution at a position in an eight-mat room at a height of 1700 mm from the mat when the ion diffusing apparatus according to the comparative example 2 of the refrigerator is operated.

FIG. 37 shows a concentration of so-called cluster ions which are discharged from the outer-side ion blowout opening 22 of the refrigerator 200 having the ion diffusing apparatus 110*a* of the comparative example 2 and which become $H^+(H_2O)_n$ and $O_2^-(H_2O)_m$ as measured at various positions in a room at 15° C. in temperature. The room is an eight-mat room (2400 mm in height, 3600 mm in width and 3600 mm in length). The measuring point is a cross section having 1700 mm in height from the floor surface of the room as shown with chain lines in FIG. 18. The wind velocity of the outer-side ion blowout opening 22 at that time is 1.5 m/s. The noise value at 1 m forward position of the refrigerator at that time is 22 dB. The control method of the ion generating apparatus 14 at that time is the same as that of the sixth embodiment.

According to FIG. 37, although ions having high concentration exist around the outer-side ion blowout opening 22, its region is narrow and the region is not always sufficient. The ion concentration at a position in front of the outer-side ion blowout opening 22 by 10 mm is about 100000 ions/cm$^3$. Although sufficient ions are generated from the ion generating apparatus 14, ions of high concentration are retained in the vicinity of the blowout opening, and the ions are not dispersed over the entire room. It can be found that the refrigerator 200 having the ion diffusing apparatus 110*a* of the comparative example 2 has a problem that the dispersing ability of ions is low with respect to the amount of ions generated.

In order to increase the region having high concentration, the rotation number of the blower 12 of the ion diffusing apparatus 110*a* should be increased, but this method has a problem that the blowing noise is largely increased. In order to increase the region having high concentration, the generating amount of microparticles of the microparticle generating apparatus should be increased. In this case, however, there is a problem that it is necessary to largely increase the voltage to be applied to the ion generating apparatus 14, the ion generating noise is increased, and the amount of ozone exploded when the ions are generated.

Although the ion diffusing apparatus 110*a* and/or the ion generating apparatus 14 of the comparative example 2 are used in many electric home appliances, this also has a problem that the dispersing ability of microparticles is low.

COMPARATIVE EXAMPLE 3

Figure 38:
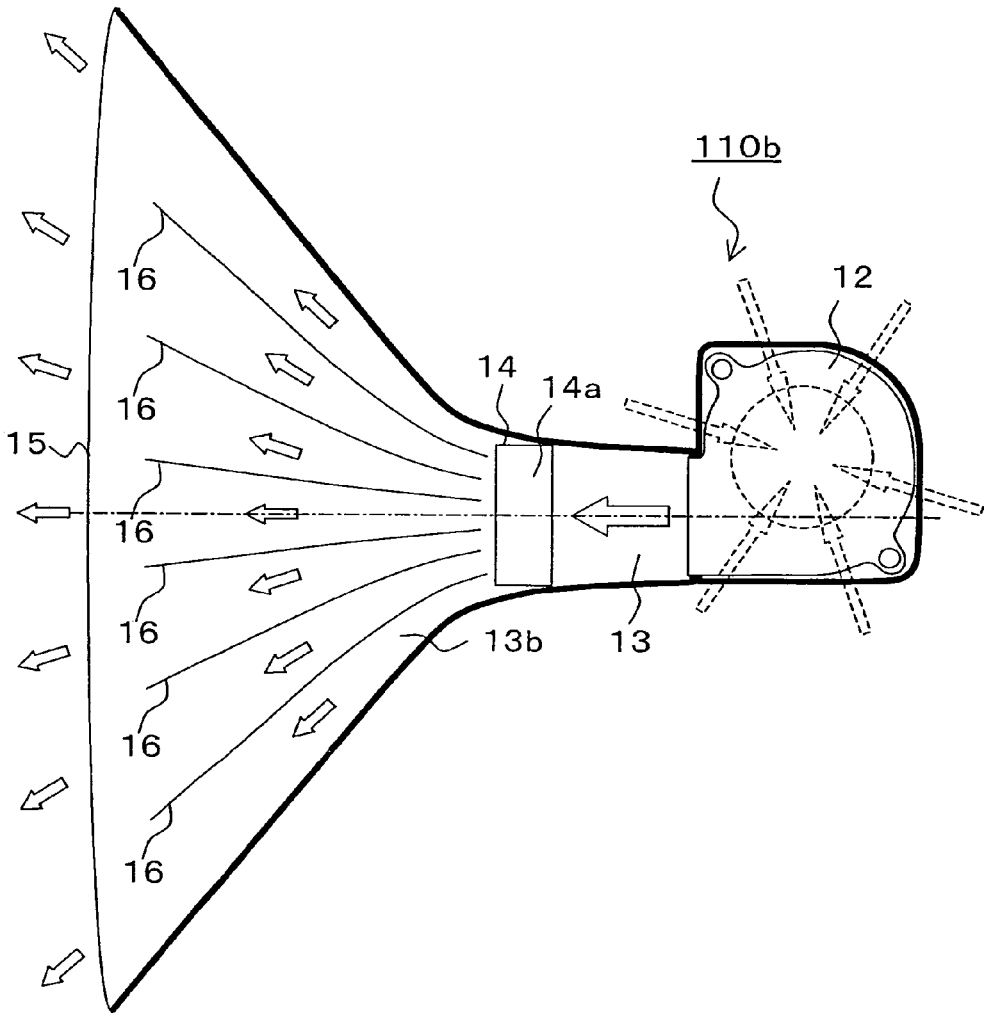
[FIG. 38] A schematic sectional plan view showing an ion diffusing apparatus of a comparative example 3.
Figure 39:
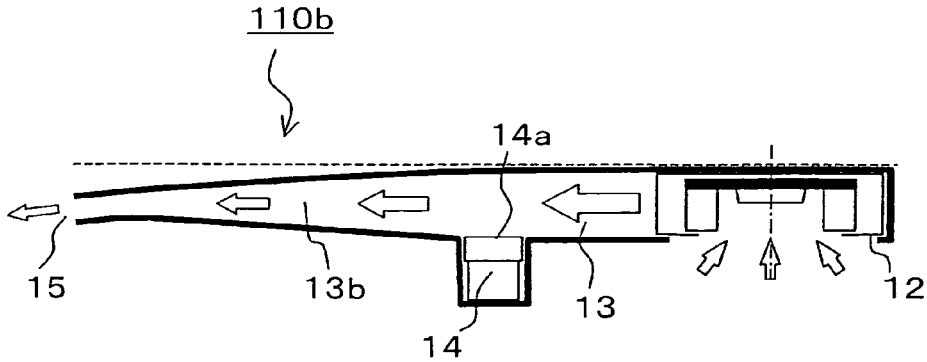
[FIG. 39] A schematic sectional side view showing the ion diffusing apparatus of the comparative example 3.

A comparative example 3 to be compared with the sixth embodiment will be explained. FIG. 38 is a schematic sectional plan view showing an ion diffusing apparatus of the comparative example 3, and FIG. 39 is a schematic sectional side view showing the ion diffusing apparatus of the comparative example 3.

In the ion diffusing apparatus 110*b* of the comparative example 3, the narrow portion 13*a* of the sixth embodiment is omitted. Therefore, although the pressure loss of the wind-blowing path 3 is reduced, the disturbance of air flowing in the vicinity of the electrical discharging surface 14*a* of the ion generating apparatus 14 can not be rectified, and deviation of flow, i.e., so-called drift generated downstream of the blower 12 can not be suppressed. That is, the probability of collision between the ions caused by the disturbance of the air current is increased and thus, the amount of ions which disappear is increased, and the lifetime of ion is shortened. The air flowing in the vicinity of the electrical discharging surface 14*a* is not uniform due to the disturbance or deviation of the air current, and the generating rate of ions above the electrical discharging surface 14*a* of the ion generating apparatus 14 is lowered. That is, higher voltage or greater amount of wind is required to secure the desired ion generating amount, and the noise is increased. The deviated air current includes ions and flows through the enlarged pipe portion 13*b*, and is sent out from the diffusing apparatus blowout opening 15. Therefore, deviation is generated also in the wind velocity distribution in the longitudinal direction of the diffusing apparatus blowout opening 15. Thus, deviation of the ion concentration of the downstream portion of the diffusing apparatus blowout opening 15 is generated on the plane which is perpendicular to the flowing direction, and the dispersing ability of ion is deteriorated.

COMPARATIVE EXAMPLE 4

Figure 40:
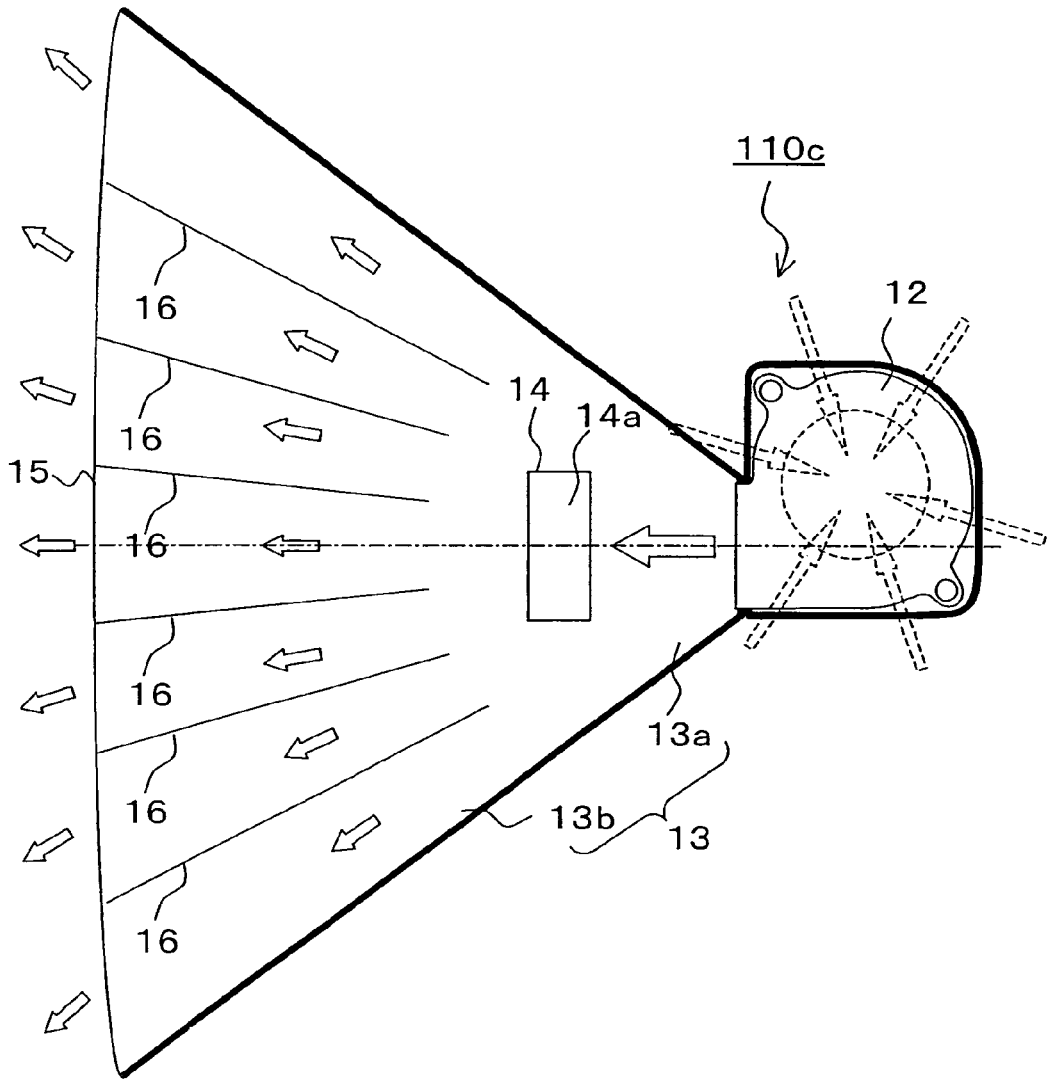
[FIG. 40] A schematic sectional plan view showing an ion diffusing apparatus of a comparative example 4.

A comparative example 4 to be compared with the sixth embodiment will be explained. FIG. 40 is a schematic sectional plan view showing an ion diffusing apparatus of the comparative example 4. The schematic sectional side view thereof is the same as that of the sixth embodiment shown in FIG. 15.

In the ion diffusing apparatus 110*c* of the comparative example 4, the shapes and disposition of the electrical discharging surface 14*a* and the wind-blowing path 13 near the electrical discharging surface 14*a* are different from those of the ion diffusing apparatus 11*a* of the sixth embodiment. If the width of the electrical discharging surface 14*a* of the ion generating apparatus 14 in a direction perpendicular to the flowing direction is defined as w1 and the width of the wind-blowing path 13 facing the electrical discharging surface 14*a* is defined as w2, w2 is set to 2×w1. A center of the electrical discharging surface 14*a* of the ion generating apparatus 14 in a direction perpendicular to the flowing direction and the center of the wind-blowing path 13 facing the electrical discharging surface 14*a* coincide with each other. Therefore, variation is generated in the ion concentration in the direction perpendicular to the flowing direction, the ion concentration is high in the vicinity of the center of the diffusing apparatus blowout opening 15, and the ion concentration at the opposite ends is low. Especially when the deviation in air sent out from the blower 12 is large and air current flows along left or right wall surface of the wind-blowing path 13, the wind velocity of the diffusing apparatus blowout opening 15 downstream of the wall surface along which the air current flows is great, and wind velocity at location other than the diffusing apparatus blowout opening 15 is small. Therefore, the ion concentration at the downstream region where the wind velocity is small is reduced, and since air current having high wind velocity does not pass through the electrical discharging surface 14*a* of the ion generating apparatus 14, the ion generating efficiency is largely deteriorated, and the ion dispersing ability is also deteriorated.

COMPARATIVE EXAMPLE 5

Figure 41:
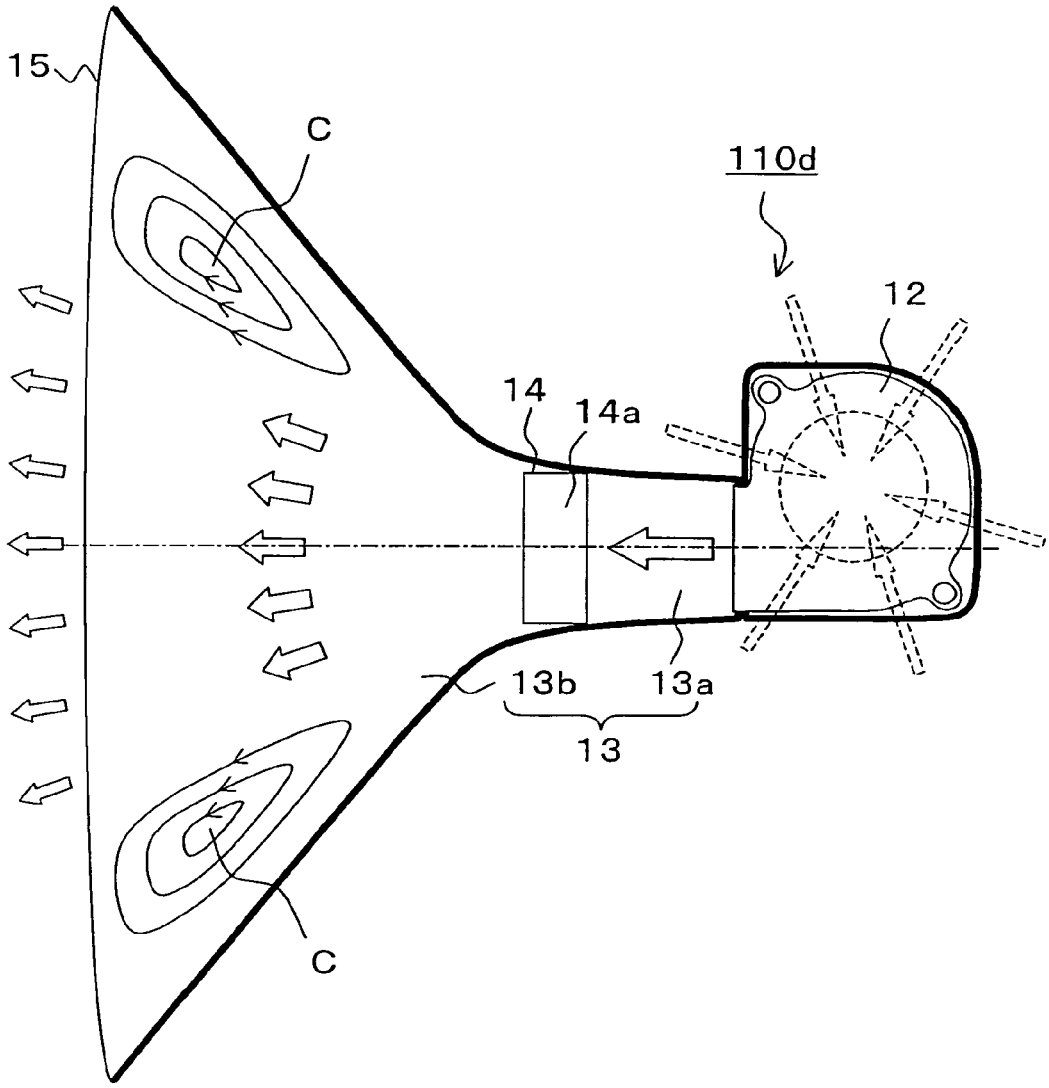
[FIG. 41] A schematic sectional plan view showing an ion diffusing apparatus of a comparative example 5.

A comparative example 5 to be compared with the sixth embodiment will be explained. FIG. 41 is a schematic sectional plan view showing an ion diffusing apparatus of the comparative example 5. The schematic sectional side view thereof is the same as that of the sixth embodiment shown in FIG. 15.

In the ion diffusing apparatus 110*d* of the comparative example 5, the wind introducing plate 16 of the ion diffusing apparatus 11*a* of the sixth embodiment is omitted. Thus, the air current is separated from the left and right wall surfaces of the enlarged pipe portion 13*b*, and diffuser effect can not be obtained, a swirl region is generated in the region C shown in FIG. 41, and the wind blowing efficiency is deteriorated. Further, the air current is not laterally dispersed in a wide range, the air flows around the center area of the diffusing apparatus blowout opening 15 in poor balance and thus, ions are not laterally dispersed in a wide range and dispersed only in one direction. Further, since the aspect ratio at the diffusing apparatus blowout opening 15 is not optimized, the spray travel distance of air current is shortened. Therefore, the ion dispersing ability is deteriorated.

COMPARATIVE EXAMPLE 6

Figure 42:
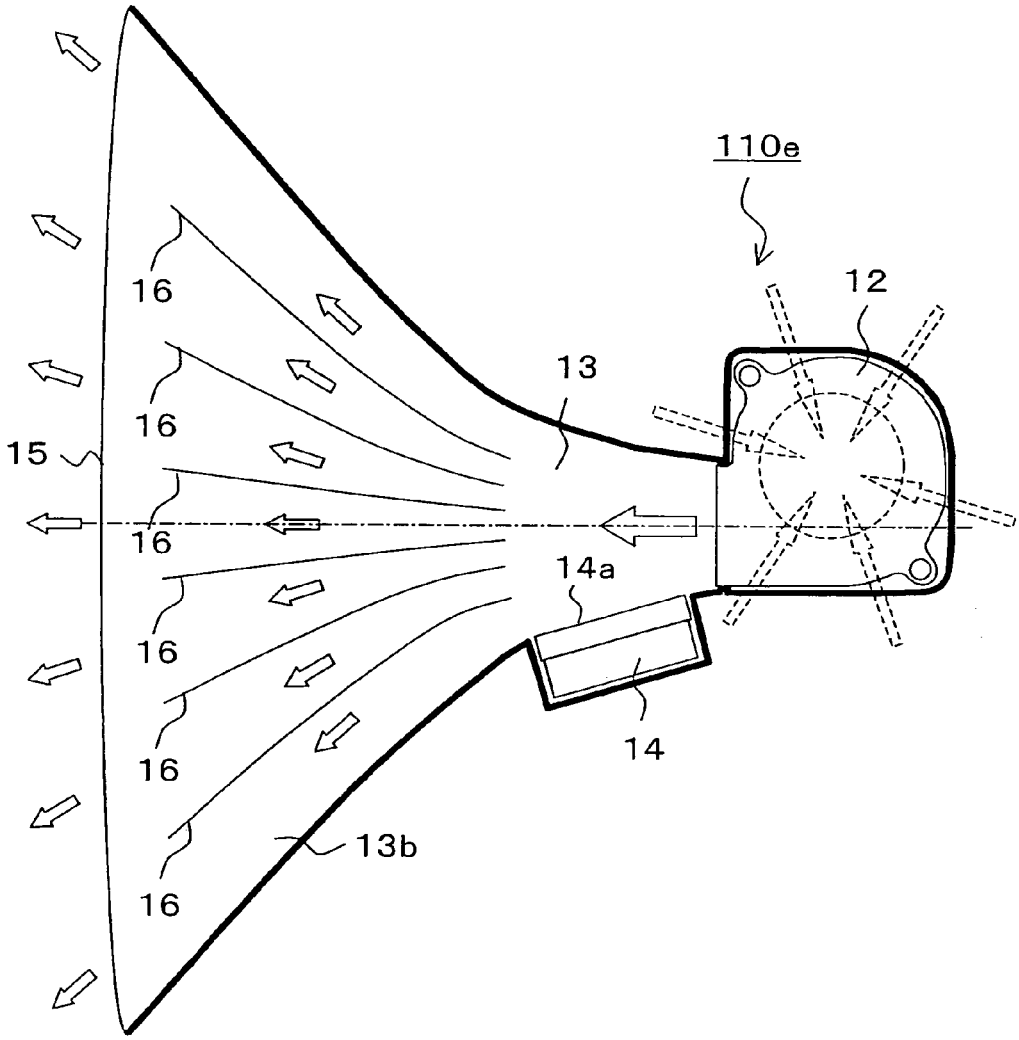
[FIG. 42] A schematic sectional plan view showing an ion diffusing apparatus of a comparative example 6.
Figure 43:
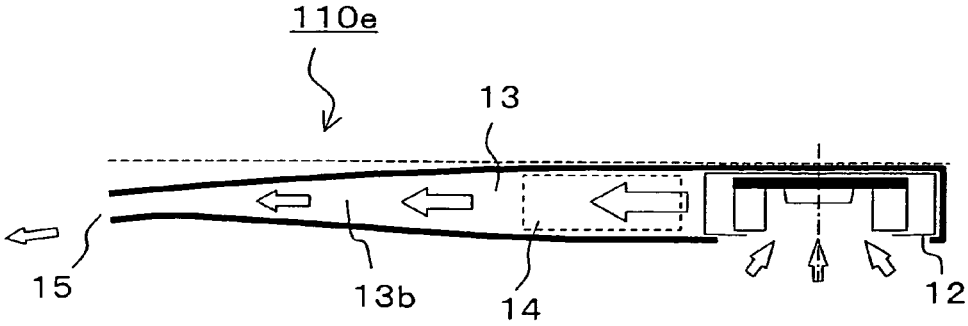
[FIG. 43] A schematic sectional side view showing the ion diffusing apparatus of the comparative example 6.

A comparative example 6 to be compared with the sixth embodiment will be explained. FIG. 42 is a schematic sectional plan view showing an ion diffusing apparatus of the comparative example 6, and FIG. 43 is a schematic sectional side view showing the ion diffusing apparatus of the comparative example 6.

In the ion diffusing apparatus 110*e* of the comparative example 6, the position of the ion generating apparatus of the comparative example 3 is changed. That is, in the comparative example 3, the longitudinal direction of the ion generating apparatus 14 is perpendicular to the flowing direction of the air current. In the comparative example 6, the longitudinal direction of the ion generating apparatus 14 is in parallel to the flowing direction of the air current, and is disposed on the right side wall of the enlarged pipe portion 13*b*. Therefore, in addition to the inconvenience of the comparative example 3, there is also another convenience that the concentration of ion sent out from the right side of the diffusing apparatus blowout opening 15 located downstream of the right side wall of the enlarged pipe portion 13*b* where the ion generating apparatus 14 is disposed is high, and the concentration of ion sent out from the left side and the center of the diffusing apparatus blowout opening 15 is low. That is, ions are not laterally dispersed in a wide range, and distributed to only in one direction (right direction), and the ion dispersing ability is deteriorated.

INDUSTRIAL APPLICABILITY

The microparticle diffusing apparatus of the present invention can be used as a diffusing apparatus of cluster ion or water vapor, and can be incorporated in various electric home appliances.

The invention claimed is:

1. A microparticle diffusing apparatus comprising:

a microparticle generating apparatus that generates microparticles from a microparticle generating part; and a wind-blowing path which conveys the microparticles generated by the microparticle generating apparatus and that discharges the conveyed microparticles from a blowout opening located at an end of the wind-blowing path, wherein, the wind-blowing path gradually decreases in height and also gradually increases in width as the wind-blowing path extends from the microparticle generating part to the blowout opening, an aspect ratio of a cross section of the wind-blowing path gradually increases as the wind-blowing path extends from the microparticle generating part to the blowout opening, and an aspect ratio AR of a cross section of the blowout opening in the wind-blowing path is in a range of $2 \leqq AR \leqq 20$.

2. A microparticle diffusing apparatus comprising:

a microparticle generating apparatus that generates microparticles from a microparticle generating part; and a wind-blowing path that conveys the microparticles generated by the microparticle generating apparatus and that discharges the conveyed microparticles from a blowout opening located at an end of the wind-blowing path, wherein, the wind-blowing path gradually decreases in height and also gradually increases in width as the wind-blowing path extends from the microparticle generating part to the blowout opening, an aspect ratio of a cross section of the wind-blowing path gradually increases as the wind-blowing path extends from the microparticle generating part to the blowout opening, and an aspect ratio AR of a cross section of the blowout opening in the wind-blowing path is in a range of $5 \leqq AR \leqq 22$.

3. A microparticle diffusing apparatus comprising:

a microparticle generating apparatus that generates microparticles from a microparticle generating part; and a wind-blowing path that conveys the microparticles generated by the microparticle generating apparatus and that discharges the conveyed microparticles from an associated blowout opening located at an end of the wind-blowing path, wherein, the wind-blowing path gradually decreases in height and also gradually increases in width as the wind-blowing path extends from the microparticle generating part to the associated blowout opening, an aspect ratio of a cross section of the wind-blowing path gradually increases as the wind-blowing path extends from the microparticle generating part to the blowout opening, the wind-blowing path is divided into a plurality of paths, each path is fitted with an associated blowout opening from which the conveyed particles are discharged, and an aspect ratio AR of a cross section in the associated blowout opening of each divided path is in a range of $5 \leqq AR \leqq 20$.

4. A microparticle diffusing apparatus comprising:

a microparticle generating apparatus that generates microparticles from a microparticle generating part; and a wind-blowing path that conveys the microparticles generated by the microparticle generating apparatus and that discharges the conveyed microparticles from an associated blowout opening located at an end of the wind-blowing path, wherein, the wind-blowing path gradually decreases in height and also gradually increases in width as the wind-blowing path extends from the microparticle generating part to the associated blowout opening, an aspect ratio of a cross section of the wind-blowing path gradually increases as the wind-blowing path extends from the microparticle generating part to the blowout opening, the wind-blowing path is provided with a plurality of paths divided by wind-introducing plates, each path has an associated blowout opening for discharging the transferred microparticles, and an aspect ratio AR of a cross section of the associated blowout opening of each path divided by each wind introducing plate is in a range of $5 \leqq AR \leqq 20$.

5. A refrigerator comprising:

a microparticle generating apparatus that generates microparticles from a microparticle generating part; and a wind-blowing path that conveys the microparticles generated by the microparticle generating apparatus to an associated blowout opening located at an end of the wind-blowing path, the associated blowout opening discharging and dispersing the conveyed microparticles into a living space around a front portion of the refrigerator, wherein, the wind-blowing path gradually decreases in height and also gradually increases in width as the at least one wind-blowing path extends from the microparticle generating part to the associated blowout opening, an aspect ratio of a cross section of the wind-blowing path gradually increases as the wind-blowing path extends from the microparticle generating part to the associated blowout opening, and the blowout opening is provided in an upper portion of the front portion of the refrigerator.

6. The refrigerator according to claim 5, wherein the wind-blowing path and the associated blowout opening are angled downward from a horizontal plane so that the microparticles are discharged and dispersed downward from the associated blowout opening with respect to the horizontal plane into the living space around the front portion of the refrigerator.

7. The refrigerator according to claim 6, wherein letting w1 be a width of the microparticle generating apparatus as measured in a direction nearly perpendicular to a flow of fluid passing through the microparticle generating part and w2 be a width of the wind-blowing path as measured in such a direction to face the microparticle generating part, a relation of $0.7 \times w1 \leqq w2 \leqq 1.3 \times w1$ is established, and an aspect ratio AR of a cross section of the wind-blowing path in a position where the microparticle generating part is disposed is equal to or less than 2.

8. The refrigerator according to claim 5, wherein letting w1 be a width of the microparticle generating apparatus as measured in a direction nearly perpendicular to a flow of fluid passing through the microparticle generating part and w2 be a width of the wind-blowing path as measured in such a direction to face the microparticle generating part, a relation of $0.7 \times w1 \leqq w2 \leqq 1.3 \times w1$ is established, and an aspect ratio AR of a cross section of the wind-blowing path in a position where the microparticle generating part is disposed is equal to or less than 2.

9. The refrigerator of claim 5, wherein an aspect ratio of a cross section of the associated blowout opening in the wind-blowing path is $2 \leqq AR \leqq 20$.

10. The refrigerator according to claim 9, wherein the wind-blowing path and the associated blowout opening are angled downward from a horizontal plane so that the microparticles are discharged and dispersed downward from the associated blowout opening with respect to the horizontal plane into the living space around the front portion of the refrigerator.

11. The refrigerator according to claim 9, wherein letting w1 be a width of the microparticle generating apparatus as measured in a direction nearly perpendicular to a flow of fluid passing through the microparticle generating part and w2 be a width of the wind-blowing path as measured in such a direction to face the microparticle generating part, a relation of $0.7 \times w1 \leqq w2 \leqq 1.3 \times w1$ is established, and an aspect ratio AR of a cross section of the wind-blowing path in a position where the microparticle generating part is disposed is equal to or less than 2.

12. The refrigerator of claim 5, wherein an aspect ratio of a cross section of the associated blowout opening in the wind-blowing path is $5 \leqq AR \leqq 22$.

13. The refrigerator according to claim 12, wherein the wind-blowing path and the associated blowout opening are angled downward from a horizontal plane so that the microparticles are discharged and dispersed downward from the associated blowout opening with respect to the horizontal plane into the living space around the front portion of the refrigerator.

14. The refrigerator according to claim 12, wherein letting w1 be a width of the microparticle generating apparatus as measured in a direction nearly perpendicular to a flow of fluid passing through the microparticle generating part and w2 be a width of the wind-blowing path as measured in such a direction to face the microparticle generating part, a relation of $0.7 \times w1 \leqq w2 \leqq 1.3 \times w1$ is established, and an aspect ratio AR of a cross section of the wind-blowing path in a position where the microparticle generating part is disposed is equal to or less than 2.

15. The refrigerator of one of claim 5, wherein at least a portion of the wind-blowing path is divided into a plurality of wind-blowing paths that are each provided with an associated blowout opening for discharging and dispersing the conveyed microparticles into the living space around the front portion of the refrigerator and an aspect ratio of a cross section of the associated blowout opening in each divided wind-blowing path is $5 \leqq AR \leqq 20$.

* * * * *